US007065839B2

(12) United States Patent
Just

(10) Patent No.: US 7,065,839 B2
(45) Date of Patent: Jun. 27, 2006

(54) MAGNETIC BOOKMARK UTILIZING BUILT-IN FULCRUM AND LEVERS

(76) Inventor: George J. Just, 2126 N. Sawyer, Suite 102, Chicago, IL (US) 60647

( * ) Notice: Subject to any disclaimer, the term of this patent is extended or adjusted under 35 U.S.C. 154(b) by 99 days.

(21) Appl. No.: 09/982,455

(22) Filed: Oct. 23, 2001

(65) Prior Publication Data

US 2003/0074769 A1 Apr. 24, 2003

(51) Int. Cl.
*A44B 21/00* (2006.01)

(52) U.S. Cl. ..... 24/67 R; 24/303; 116/234

(58) Field of Classification Search ..... 24/303, 24/66.1, 67 R; 248/206.5; 335/285, 303, 335/304; 116/234–237; 281/42
See application file for complete search history.

(56) References Cited

U.S. PATENT DOCUMENTS

| | | | | |
|---|---|---|---|---|
| 2,448,611 A | | 9/1948 | Martin | |
| 2,693,370 A | * | 11/1954 | Wheatley | 24/67 R |
| 2,713,844 A | | 7/1955 | Mueller | |
| 3,253,194 A | * | 5/1966 | Parker | 335/302 |
| 3,577,583 A | * | 5/1971 | Amann | 16/87.2 |
| 4,255,837 A | | 3/1981 | Holtz | |
| 4,258,493 A | | 3/1981 | Kettlestrings et al. | |
| 4,829,855 A | * | 5/1989 | Martinez | 81/44 |
| 4,830,321 A | * | 5/1989 | Irie | 248/206.5 |
| 4,971,278 A | * | 11/1990 | Woods | 248/206.5 |
| 5,103,756 A | | 4/1992 | Korkames | |
| 5,425,160 A | * | 6/1995 | Krapf | 24/67 R |
| 5,517,722 A | * | 5/1996 | Bender | 16/87.2 |
| 5,771,618 A | * | 6/1998 | Burke et al. | 40/600 |

FOREIGN PATENT DOCUMENTS

| | | | |
|---|---|---|---|
| DE | 2648064 B | * | 3/1978 |
| DE | 29717216 U1 | * | 11/1997 |
| JP | 61137306 A | * | 6/1986 |
| JP | 09213522 A | * | 8/1997 |
| JP | 2000062372 A | * | 2/2000 |
| JP | 2000225789 A | * | 8/2000 |
| JP | 2000318362 A | * | 11/2000 |
| JP | 2000343864 A | * | 12/2000 |

* cited by examiner

*Primary Examiner*—James R. Brittain

(57) ABSTRACT

A magnetic clip comprising a combined magnetic member/second firm plate unit (34) lever, and a second flexible film (27) which is wrapped around and attached to said combined magnetic member/second firm plate unit lever, and an opposing ferric armature member (22) lever, and a folded flexible attachment means (26) to which said opposing levers are adhered under said fold. The lower proximal edge of said magnetic member serves as a fulcrum (44) about which said two levers can be pivoted by the operator's fingers of only one hand which can raise or lower portions (52), (56), (54), and (58) thereby causing the leading edges of said clip to open or close as needed to secure or release said clip to or from a sheet (30). Closed life size view (84).

4 Claims, 18 Drawing Sheets

FIG. 1A
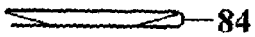
FIG. 1B
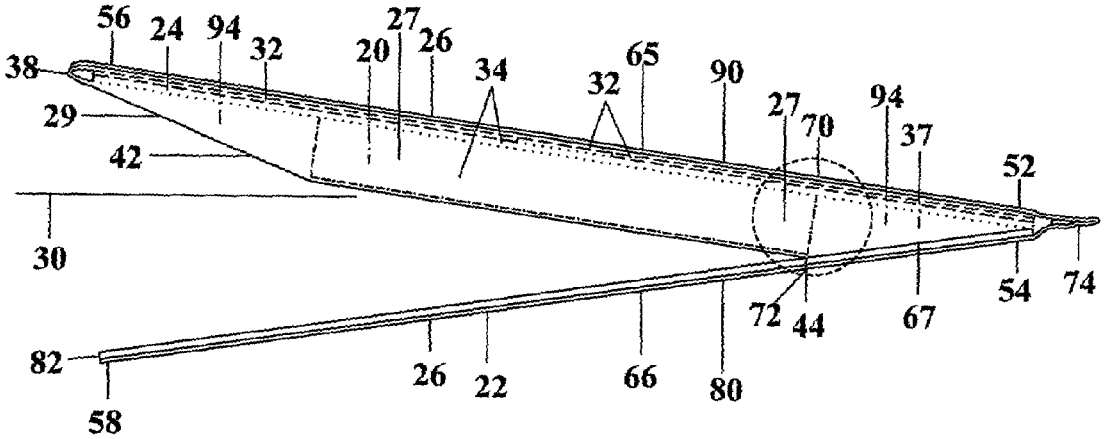
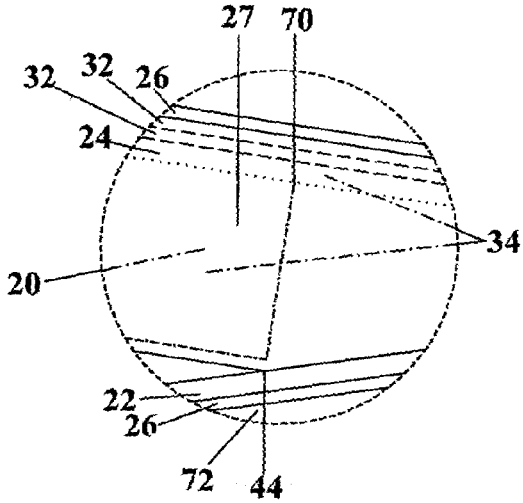
FIG. 1C

FIG. 9A
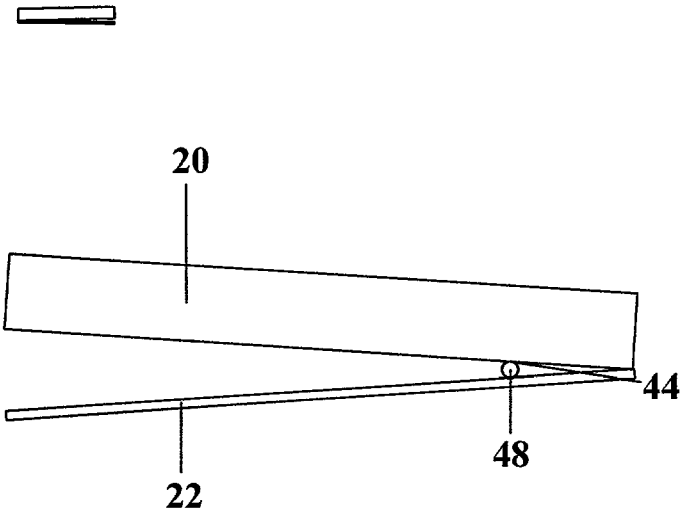
FIG. 9B
FIG. 10A
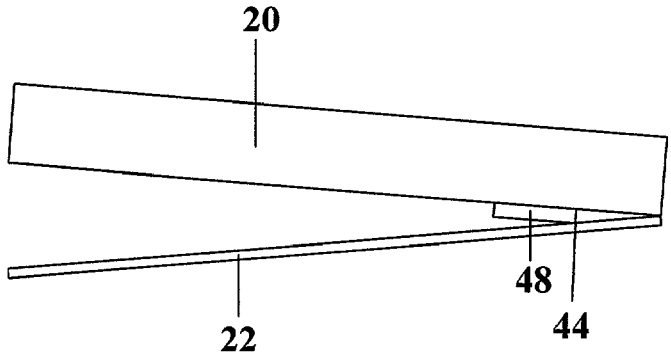
FIG. 10B

FIG. 14A
FIG. 14B
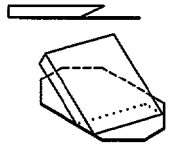
FIG. 14C
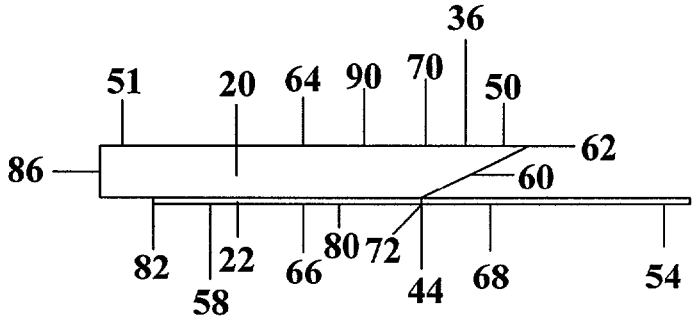
FIG. 14D
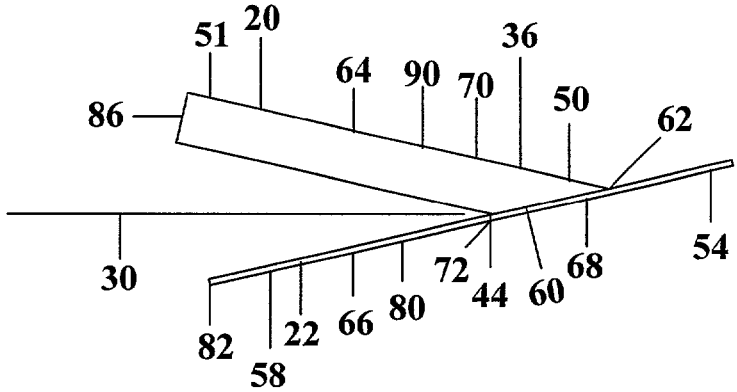
FIG. 14E
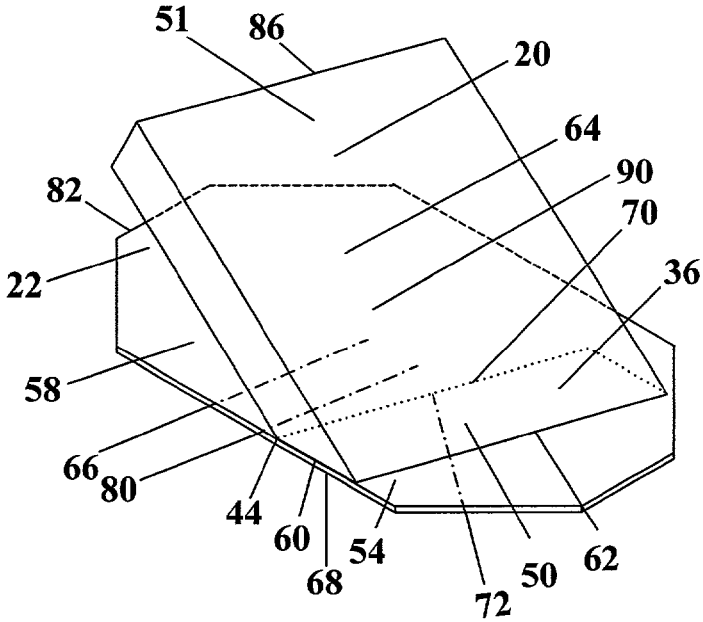

MAGNETIC BOOKMARK UTILIZING BUILT-IN FULCRUM AND LEVERS

CROSS REFERENCE TO RELATED APPLICATIONS

Not applicable

BACKGROUND

1. Field of Invention

This invention relates to magnetic clips, specifically to an improved construction of magnetic clips which are user friendly because they have fulcrum and lever controls built into them which enable an operator while using only one hand to place or remove the magnetic clip onto or off of a particular location on a sheet or set of stacked sheets in a book.

2. Description of Prior Art

Several magnetic clips are known which can be attached to a set of object or objects, such as a book sheet or sheets. These known magnetic clips and my invention have several structural and functional characteristics in common. At a particular location on a sheet or clamped group of sheets several of these known magnetic clips and my invention magnetically and frictionally clamp or unclamp that sheet or group of sheets between two opposing magnetically attracted members held in a face to face parallel alignment by magnetic attraction.

When the fabricator of my preferred embodiment or its prior art equivalent anticipates that the operator will need to grasp several sheets of paper simultaneously the fabricator will allow sufficient slack portions of the attachment means in the hinge fold area so the slack portions can be vertically expandable enough to allow the grasped set of article or articles to force the slack attachment means sections to expand vertically to create the vertical space needed to house the volume of space required by the varying vertical dimensions of the grasped set of multiple sheets.

The attachment means has an intrinsic ability to automatically return an open magnetic clip to a previously aligned closed position because the attachment means can be constructed out of a wide variety of flexible materials, such as paper, rubber, leather, plastic, and various impregnated fibrous material, many of which have an intrinsic ability after a few foldings to imprint a memory within their own affected molecular structure of where the hinge had previously been folded and therefore a proclivity to automatically return to the same aligned closed position from an open position with little or no guidance from the operator's digits; and All of the previous magnetic clips heretofore known suffer from a number of disadvantages:

A) One negative characteristic that most of these known magnetic clips share, but my invention does not, is that when both opposing firm structure members are held in a face to face parallel alignment along a major planar surface of each member by magnetic attraction, before being attached to a sheet or set of stacked sheets, the magnetic bond which holds the distal sections of each element to its opposing member is difficult to disengage with only one hand. The opposing magnetically attached elements should be quickly separable at their leading edges so that each opposing element can be easily placed on either side of the targeted sheet, and at a particular location on the sheet. When the opposing members are reunited with each other the magnetic bond will be reestablished and the clip will have gained a significant purchase upon the targeted sheet so that a significant remainder of both opposing elements can be simultaneously slid inwards on either side of the targeted location on a sheet of paper and thereby become securely attached to the sheet at that location.

B) Worse yet, on many prior art magnetic clips, the magnetic bond is frequently so strong between the opposing members that the separation of the leading edges of the opposing members from each other absolutely requires manipulation by digits from two hands to break the magnetic bond holding the opposing members to each other. After separation it is sometimes possible for the operator to position the opposing clip members on either side of the targeted set of object or objects using the digits of one hand, but more often the digits of both hands will be needed. Frequently, considerable further digital manipulation of the clipping device is required from dexterous fingers to finally move the clip's opposing members towards each other until they are again magnetically bonded to each other and now frictionally retain the targeted sheet or set of stacked sheets between the clip members. Handicapped persons with even a slight lack of digital motor skills find prior art magnetic clips difficult to manipulate.

C) Inventors of other known magnetic clips concentrated mainly on establishing that magnetic clips containing thin magnetically bonded plates could well perform the role of frictionally retaining a sheet or set of stacked sheets between two opposing magnetically bonded thin plates. The concept of using a lever and fulcrum that is actually built into a thin magnetic clip to help separate the leading edges of opposing plate members from each other has not been known in the art of creating magnetic clips prior to this invention.

D) Many prior art magnetic clips require that specific polarities be imposed upon a magnetic member so it can be properly mated to a facing oppositely polarized magnetic member and thereby achieve their magnetic bond. These prior art clips need magnets whose polarity configurations are sensitive and critical so that they are expensive to fabricate in-house and even more expensive to purchase on the open market. U.S. Pat. Nos. 5,103,756 to Korkames (1992), 4,258,493 to Kettlestrings (1981), and 4,255,837 to Holtz (1981), all specify that opposing magnets are needed, and that opposite poles face opposite one another. All these magnetic clips are more difficult to operate with one hand than mine is, as are the magnetic clips seen in U.S. Pat. Nos. 2,713,844 to Mueller (1955), and 2,448,611 to Martin (1948). However prior art magnetic clips can be useful when teaching magnetism, since they can be used to demonstrate the concrete object lesson that magnets with multiple opposing polarities can be attracted to each other along all the opposing polarities. My embodiments also can be fabricated to teach this concrete object lesson since all of my embodiments, including the preferred embodiment, can be fabricated so that an armature member (22) lever when constructed of a firm magnetic member lever with oppositely polarized magnetic domains to that of the magnetic domains of the magnetic member (20) lever can be substituted for the ferric armature member (22) lever specified in all of my embodiments.

E) In the majority of usage events the skilled operator will prefer to maximally insert the magnetic clip so that its fold directly abuts the edge of the targeted sheet. While using the prior art clips to abut the sheet's edge with the attachment means's fold the operator would have to slide 90%+ sections of the inside surfaces of both opposing elements of the clip over and under the surfaces of the targeted sheet until sheet-edge to attachment-means-fold abutment occurs. In the same situation my clip with a lever and fulcrum will require only the sliding of those inside surface sections of the clip which are located proximally to the fulcrum, about 12% of the entire average device, to be easily slid over and under the surfaces of the targeted sheet until the sheet-edge to attachment-means-fold abutment occurs. To abut the fold of prior art bookmarks with the edge of the targeted sheet usually requires the sliding of the prior art clip inwards and over and under the targeted sheet commencing at the very front of the clip and ending at the rear of the clip where the fold is constructed. Consequently, while using only the digits of one hand, 95% of the prior art's clip usually has to be slid inwards over and under the surfaces of the targeted sheet to achieve sheet-edge to attachment-means-fold abutment whereas only 12% of my clip has to be slid inwards over and under the surfaces of the targeted sheet to achieve sheet-edge to attachment-means-fold abutment, all the while using only two fingers of one hand. The sheet-edge to attachment-means-fold abutment is desirable because this minimizes the inadvertent dislodging of the clip from its marked sheet, and because the less sliding of the device over a delicate sheet of paper the less chance that the sheet of paper will be wrinkled or torn during the clipping process.

SUMMARY

In accordance with the present invention a magnetic clip comprises a built-in fulcrum strategically situated between built-in opposing magnet lever and keeper lever.

OBJECTS AND ADVANTAGES

According, several objects and advantages of the present invention are:

A) The manufacturing and assembling process is much less expensive for my main embodiment than for prior art clips because:

1) Several of my embodiments use a detachable magnetic member lever magnetically bondable to a ferric armature member lever to accomplish the magnetic bonding function but at a very much lower cost in materials and at an extremely lower cost of assembling of the device because precautions necessary for precisely matching opposite polarized magnetic members is obviated when the armature member lever is a non-magnetized ferric plate lever.

2) My main embodiment can utilize any predeterminingly dimensioned magnetic member (20) lever providing it is of sufficient thickness so that one of its edges can serve as a fulcrum (44) as shown in FIGS. 1B, 3B, 4F, and 5B.

3) My device can use any predeterminingly sized permanent magnetic member lever with the correct magnetic reach-out product which can easily be calibrated by the designer.

4) Most of my embodiments can be inexpensively fabricated into various shapes, rectilinear, circular, oblong, triangular, multiply vertexed, even 3-dimensional, especially in bas relief.

B) This device, especially when built with large heavy levers, can also force a spread open book to remain spread open at a particular sheet after this device has been attached to that particular sheet thereby holding that top sheet down which will in turn hold down the other sheets underneath.

C) Skilled operators prefer to use a lever and fulcrum enhanced magnetic clip which requires less sliding over and under the targeted sheet as it is being attached to the sheet or sheets with the use of two or more digits of one hand than the prior art clips require. My clip is user friendly since it saves operator's time, mental energy, motion, and money.

D) My leading edges always separate from each other when only slight digital pressure is applied upwards or downwards as desired to the proximal section of either lever located to the rear of the fulcrum using only the digits of one hand. When it is desirable to clip one sheet or even several stacked sheets at one time it helps to have leading edges on the clip that can be easily separated with the aid of an inbuilt lever and fulcrum E) While being easily operated with only the digits on one hand my clip requires minimal sliding over and under the targeted sheet while being attached to the perimeter of a very thin sheet of paper and hence will lower the incidence of wrinkling of the targeted thin sheet. When prior art clips are operated with one hand or even two hands they often require inward sliding of the opposing elements over and under the targeted surfaces of a thin sheet right from the tip of the clip's leading edges to the proximal edges of the opposing elements thereby increasing the risk of wrinkling the sheet.

DRAWING FIGURES

In the drawings, closely related figures have the same number but different alphabetic suffixes.

FIG. 1A shows a life size left orthographic view of the preferred embodiment of this magnetic clip invention.

FIG. 1B shows an enlarged left orthographic view of same FIG. 1A magnetic clip, but whose opposing levers are elevated away from each other and these opposing levers are dwellingly poised on opposite sides of a targeted sheet of paper. Hidden elements are represented by dots or broken lines.

FIG. 1C shows an enlarged circular detailed cross section view of circularly outlined section of section shown in FIG. 1B.

FIG. 9A shows a life size left orthographic view of another embodiment of a closed magnetic clip.

FIG. 9B shows an enlarged open position left orthographic view of same magnetic clip shown in FIG. 9A.

FIG. 10A shows a life size left orthographic view of another embodiment of a closed magnetic clip.

FIG. 10B shows an enlarged open position left orthographic view of same magnetic clip shown in FIG. 10A.

FIG. 14A shows a closed life size left orthographic view of another magnetic clip embodiment.

FIG. 14B shows a life size left isometric view of said FIG. 14A magnetic clip in the open position.

FIG. 14C shows an enlargement of said FIG. 14A.

FIG. 14D shows an enlarged left orthographic view of FIG. 14A magnetic clip whose opposing levers are elevated away from each other and whose opposing levers are dwellingly poised on opposite sides of a targeted sheet of paper.

FIG. 14E shows an enlarged open position left isometric view of said FIG. 14B.

Figure 1D:
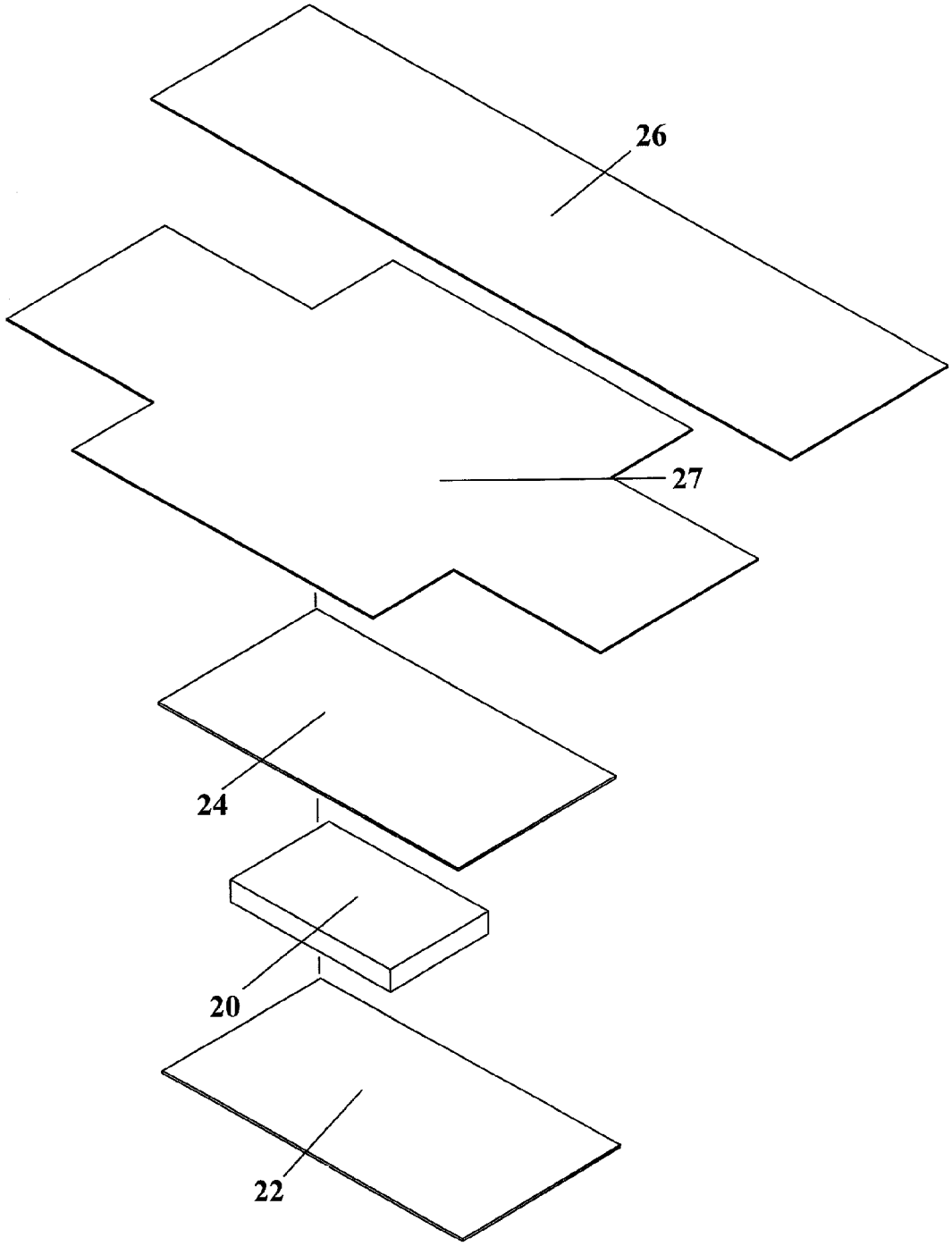
FIG. 1D shows an exploded isometric view of all five parts of the magnetic clip shown in FIG. 1A.

| Reference Numerals in Drawings | |
|---|---|
| 20 | magnetic member |
| 22 | armature member |
| 24 | second firm plate |
| 25 | first flexible film |
| 26 | attachment means |
| 27 | second flexible film |
| 28 | first flexible film paper guide |
| 29 | second flexible film paper guide |
| 30 | targeted sheet |
| 32 | flap(s) of second flexible film |
| 34 | combined magnetic member/second firm plate unit |
| 36 | location where portion of one opposing finger is pressed inwardly at a point on the magnetic member's outer surface that is proximal to the fulcrum |
| 37 | location where portion of one opposing finger is pressed inwardly at a point on the combined magnetic member/second firm plate unit's outer surface that is proximal to the fulcrum |
| 38 | distal end of magnetic member |
| 40 | distal slanted surface of the first flexible film paper guide |
| 42 | distal slanted surface of the second flexible film paper guide |
| 43 | inner vertex |

-continued

| Reference Numerals in Drawings | |
|---|---|
| 44 | fulcrum |
| 46 | second magnetic member |
| 48 | preferably linear protrusion |
| 50 | load at proximal portion of magnetic member |
| 51 | load at distal portion of magnetic member |
| 52 | load at proximal portion of combined magnetic member/second firm plate unit |
| 54 | load at proximal portion of armature member |
| 56 | load at distal portion of combined magnetic member/second firm plate unit |
| 58 | load at distal portion of armature member |
| 60 | beveled edge |
| 62 | proximal end of magnetic member |
| 64 | portion of one opposing finger is pressed inwardly at a point on the magnetic member's outer surface that is distal to fulcrum |
| 65 | portion of one opposing finger is pressed inwardly at a point on the combined magnetic member/second firm plate unit's outer surface that is distal to fulcrum |
| 66 | portion of one opposing finger is pressed inwardly at a point that is distal to the fulcrum on the armature member's outer surface |
| 67 | portion of one opposing finger is pressed inwardly at a point that is proximal to the fulcrum on the armature member's outer surface |
| 68 | section of armature member opposing magnetic member's slanted surface |
| 70 | approximate point, on magnetic member, opposite fulcrum, where finger pressure is applied inwardly on magnetic member's outer surface towards fulcrum for control purposes |
| 72 | approximate point, on armature member, opposite fulcrum, where finger pressure is applied inwardly on armature member's outer surface towards fulcrum for control purposes |
| 74 | hinge fold area |
| 76 | first firm plate |
| 80 | major outer planar surface of armature member, per se, or of armature member with attachment means adhered to it |
| 82 | distal leading end of armature member |
| 84 | life size left orthographic view of closed preferred embodiment |
| 86 | distal (leading) end of magnetic member |
| 88 | targeted thick set of objects |
| 90 | major outer planar surface of magnetic member lever, or of combined magnetic member/second firm plate unit |
| 94 | interstitial crevice |
| 96 | typical signage |

DESCRIPTION—FIGS. 1A, 1B, 1C, 1D, 1E, 1F, 1G—PREFERRED EMBODIMENT

FIG. 1A shows a life size left side view of the preferred embodiment of this invention in the closed position.

FIG. 1B shows an enlarged left side orthographic view of the preferred embodiment in the open position where its leading ends (38), and (82) are elevated away from each other preparatory to grasping a targeted sheet (30) of paper, and whose hidden elements such as the flap(s) of the second flexible film (32), the second firm plate (24) lever, and the magnetic member (20) lever are illustrated in situ with dots or broken lines.

FIG. 1C shows a further enlarged circular detailed cross section view of circularly outlined section of plane shown in FIG. 1B.

FIG. 1D shows an exploded view of this preferred embodiment illustrating the attachment means (26), the second flexible film (27), the second firm plate (24) lever, the magnetic member (20) lever, and the armature member (22) lever. In the preferred embodiment the attachment means and the flexible film wrapping are made of Stevens polyurethane film available from STEVENS Elastomerics, Northampton, Mass. Typically the attachment means, and the flexible film wrapping are each comprised of a 0.004" to 0.008" thickness layer with the smaller size preferred. A bookmark clip would require the smaller thickness whereas a banknote or fabric magnetic clip would require the thicker size. The attachment means or the wrapping cover can consist of any other material that can be repeatedly flexed and unflexed 90° or more without tearing, such as polyethylene, polypropylene, nylon, rubber, leather, fabrics, cardboard, paper, etc. When used for a bookmark the second firm plate (24) lever, and the armature member (22) lever is typically a 0.007" thick ferric tin plate available from many hardware stores or sheet metal shops. A thicker ferric metal plate including ferric stainless steel should be used in a fabric or banknote magnetic clip. All of my embodiments, including this preferred embodiment, can be fabricated so that an armature member (22) lever constructed of a firm magnetic member lever with oppositely polarized magnetic domains to that of the magnetic domains of the magnetic member (20) lever can be substituted for the ferric armature member (22) lever specified in my main embodiment. In the preferred embodiment the magnetic member (20) lever consists of a widely distributed flexible permanent magnet, 0.06" thick, which can be readily machined, cut, slit, punched, drilled or milled into simple or intricate shapes. The flexible permanent magnet contains oriented barium ferrite material contained in a vulcanized nitrile rubber binder and is readily available in thickness range of 0.03" to 0.06". The magnetic member (20) lever could be comprised of any permanent magnet of the right size for the job even up to more than a one inch thickness.

The preferred embodiment as shown in FIG. 1B is typical of a small bookmark on which graphic images can be printed on all viewable surfaces, and has these life size Length×Width×Thickness dimensions: The attachment means (26) is 2.0×0.5×0.004 inches. The second flexible film (27) is 0.9375×0.5×0.004 in the non-flap area, and one set of flaps is 0.9375×0.257×0.004 inches each, and the other set of flaps is 0.5×0.46×0.004 inches each. Both the second firm plate (24) lever, and the armature member (22) lever have the same dimensions: 0.9375×0.5×0.007 inches. The magnetic member (20) lever is 0.5×0.3125×0.06.

The magnetic member (20) lever is attached in a coaxial alignment to the second firm plate (24) lever. This combination is called the combined magnetic member/second firm plate unit (34) lever. Then the second flexible film (27) is attached in a coaxial alignment to the bottom of the combined magnetic member/second firm plate unit. Next the flexible film wrapping is tautly wrapped in a coaxial alignment around the entire combined magnetic member/second firm plate unit (34) by tautly securing the flaps (32) of the second flexible film (27) to the outer surface of the combined magnetic member/second firm plate unit thereby creating a slanted surface (42) on the distal end of the second flexible film (27). The slanted surface is called the second flexible film paper guide (29).

Next the attachment means (26) is folded along its lateral axis at a point that is equally distant from the distal edge of the attachment means, and from the proximal edge of the attachment means. The combined magnetic member/second firm plate unit (34) lever, and the armature member (22) lever are mounted under the fold at opposite ends of the attachment means. The area around the fold which is not adhered to either opposing clip member is called the hinge fold area (74).

Figure 1E:
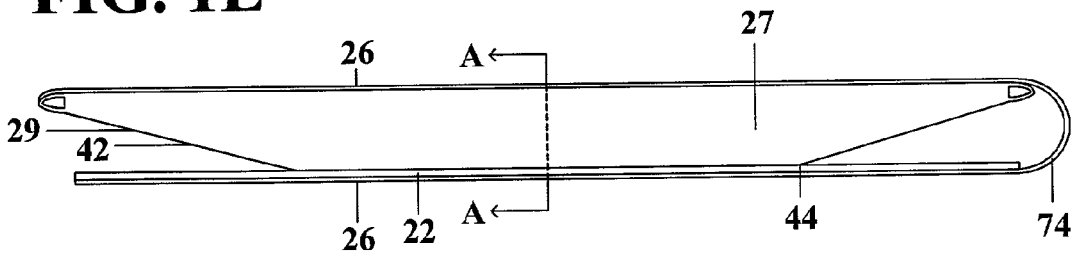
FIG. 1E shows an enlargement of said orthographic view of the closed magnetic clip shown in FIG. 1A.
Figure 1F:
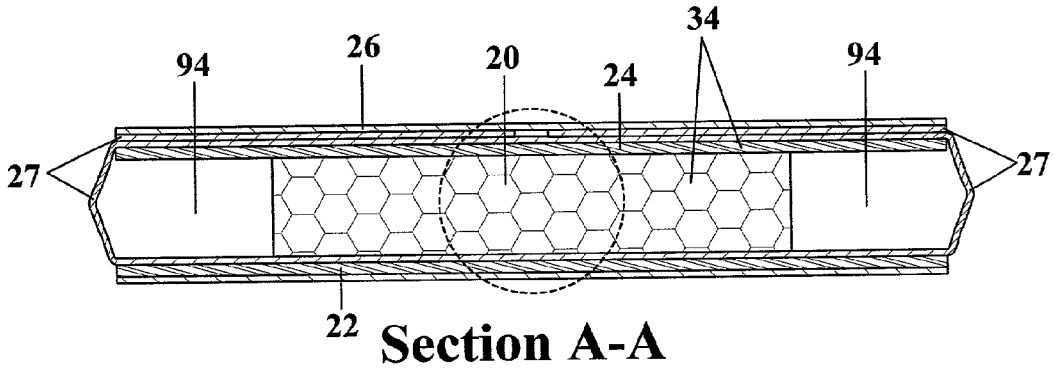
FIG. 1F shows an enlarged cross section view of said orthographic view of said closed magnetic clip shown in FIG. 1A. The cross section view is on a plane that is cut along the center lateral axis facing towards the distal section of the magnetic clip.
Figure 1G:
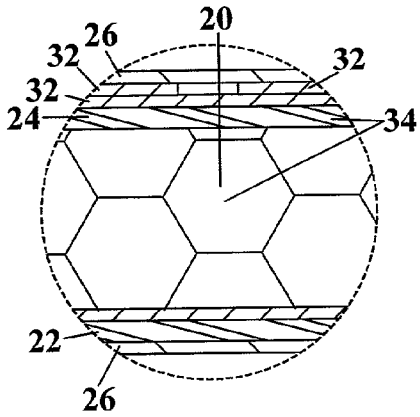
FIG. 1G shows an enlarged circular detailed cross section view of circularly outlined section of plane shown in FIG. 1F.

An enlarged left side view of the visible elements of magnetic clip shown in FIG. 1A is illustrated in FIG. 1E which shows the attachment means (26), the slanted surface (42) of the second flexible film paper guide (29), the armature member (22), the fulcrum (44), the second flexible film (27) which surrounds the combined magnetic member/second firm plate unit (34) which is not visible in this view but can readily be viewed in the cross section A—A illustrated in FIGS. 1F and 1G. FIG. 1G also shows three visible flaps (32) of the second flexible film (27).

An enlarged cross section A—A view of plane that is cut along the center lateral axis facing towards the distal section of the magnetic clip is illustrated in FIGS. 1F and 1G which show the second firm plate (24) lever, the combined magnetic member/second firm plate unit (34) lever, three of the four flaps (32) of the second flexible film (27) which wrap around the combined magnetic member/second firm plate unit (34) lever, the attachment means (26), and the armature member (22) lever.

Description—FIGS. 2A, 3A, 3B, 3C, 4C, 5A, 5B, 6A, 6B, 7B, 8A, 8D, 9A, 9B, 10A, 10B, 11B, 11C, 11D, 11E, 12B, 12C, 13B, 13C, 14C, 14D, 14E, 15A, 15B, 15C, 16A, and 17A—Additional Embodiments FIGS. 2A, 3A, 3B, 3C, 4C, 5A, 5B, 6A, 6B, 7B, 8A, 8D, 15A, 15C, and 16A show additional standalone embodiments that have similar kinds of fulcrums, and similar types of levers as does the preferred embodiment: Each has a magnetic member (20), strategically placed between armature member (22) lever, and second firm plate (24) lever. Differentiating the standalone embodiments shown in FIGS. 2A, 3A, 3B, 3C, 4C, 5A, 5B, 6A, 6B, 7B, 8A, and 8D from each other are the variations in the dimensions of the levers and fulcrums, whether an attachment means (26), a first flexible film (25), or a second flexible film (27) is attached to a particular embodiment, and whether a bottom second magnetic member (46) is attached to both the outside planar surface of armature member (22) lever and to the part of the attachment means (26) that is attached to the outside planar surface of armature member (22) lever. Various discrete structures of the preferred embodiment can be assembled together to form individual standalone magnetic clips. Like the preferred embodiment all subsequently described embodiments require that a fulcrum be constructed strategically between two levers.

FIGS. 8A, 8B, 8C, 8D, and 8F show a simple standalone embodiment where the attachment means and the flexible film wrapping of the main embodiment have not been attached, and where the three discrete pieces which comprise this standalone embodiment are similar to the three elements that comprise the core of the preferred embodiment in composition, structure, and dimensions: the magnetic member (20) lever, the armature member (22) lever, and the second firm plate (24) lever.

Figure 7A:
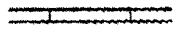
FIG. 7A shows a life size left orthographic view of another magnetic clip invention embodiment.
Figure 7B:
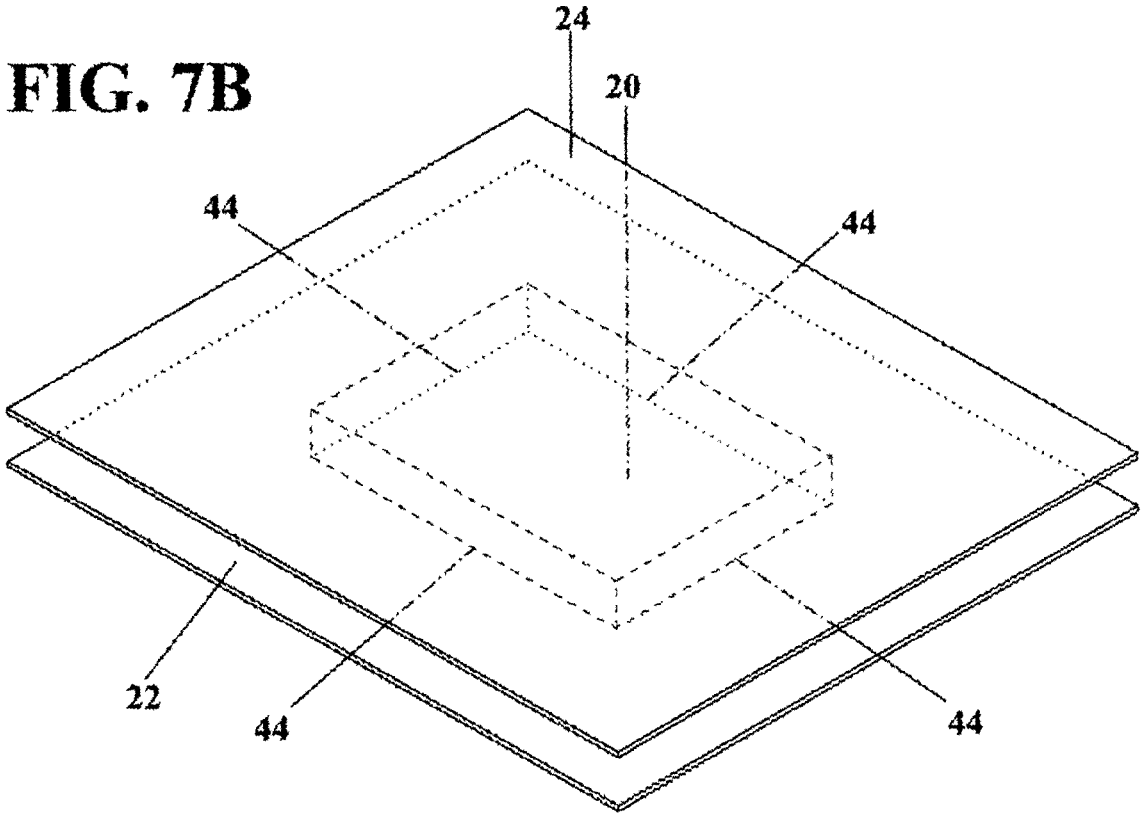
FIG. 7B shows an enlarged left isometric view of magnetic clip invention embodiment shown in FIG. 7A.

FIGS. 5A, 5B, 6A, 6B, 7A, and 7B standalone variations show that the attachment means and flexible film wrapping of the main embodiment have not been attached to any of those three standalone embodiments, plus dimensional changes have been made to various elements of those three standalone embodiments:

A) FIGS. 7A, and 7B show a standalone embodiment in the closed position where both the second firm plate lever and the armature member lever each now has these life size Length×Width×Thickness dimensions: 0.9375×0.75×0.007 inches. The addition of 0.125 inch laterally to each side of both plates allows four easy to operate fulcrum (44) possibilities when the planar surfaces of all three component elements are parallelly and concentrically aligned.

Figure 6A:
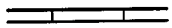
FIG. 6A shows a life size left orthographic view of another magnetic clip invention embodiment.
Figure 6B:
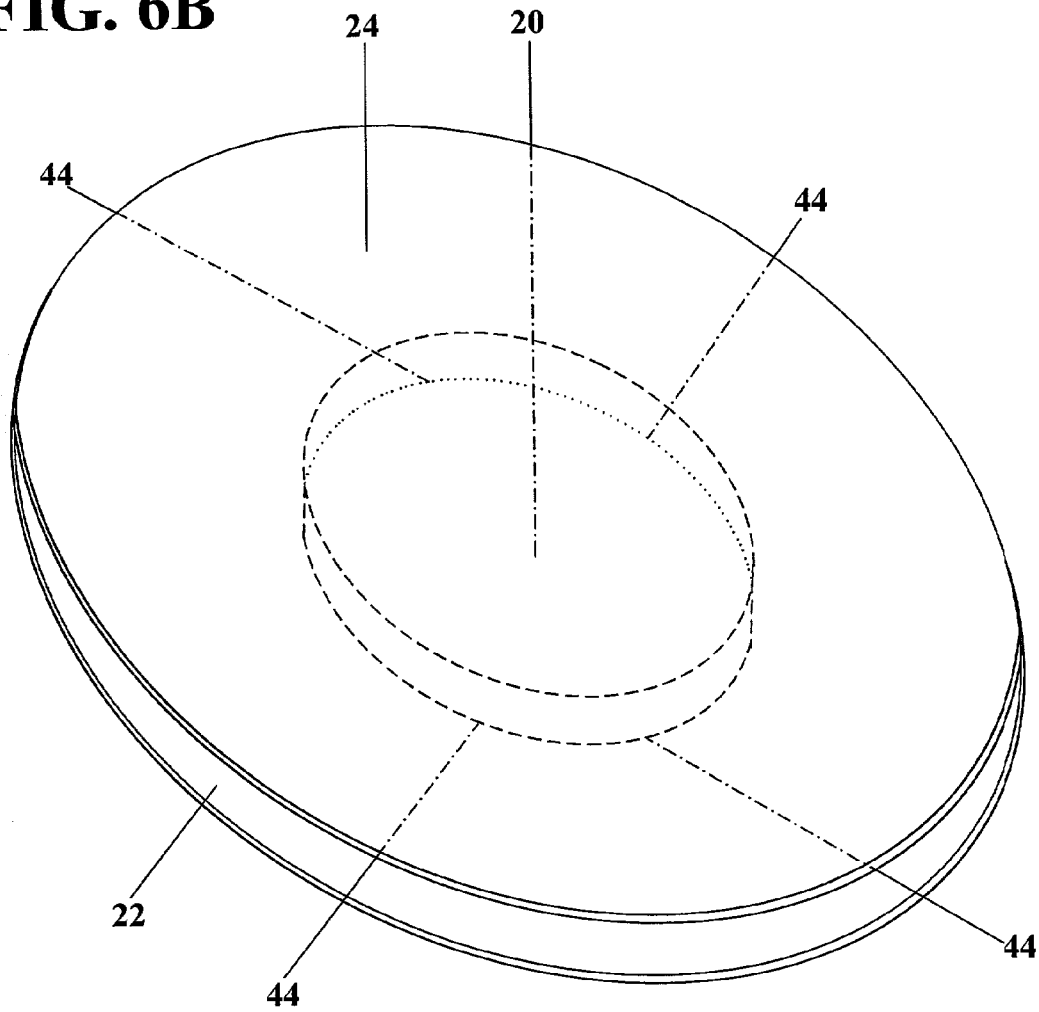
FIG. 6B shows an enlarged left isometric view of magnetic clip invention embodiment shown in FIG. 6A.

B) FIGS. 6A, and 6B show a standalone embodiment in the closed position where both the second firm plate (24) lever and the armature member (22) lever now are 0.9375 diameter inch circles and the magnetic member (20) lever is now a 0.40625 diameter inch circle thereby creating thousands of fulcrum (44) possibilities when the planar surfaces of all three component elements are parallelly and concentrically aligned.

Figure 5A:
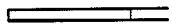
FIG. 5A shows a life size left orthographic view of a magnetic clip similar to FIG. 8A except that a larger magnet has been installed.
Figure 5B:
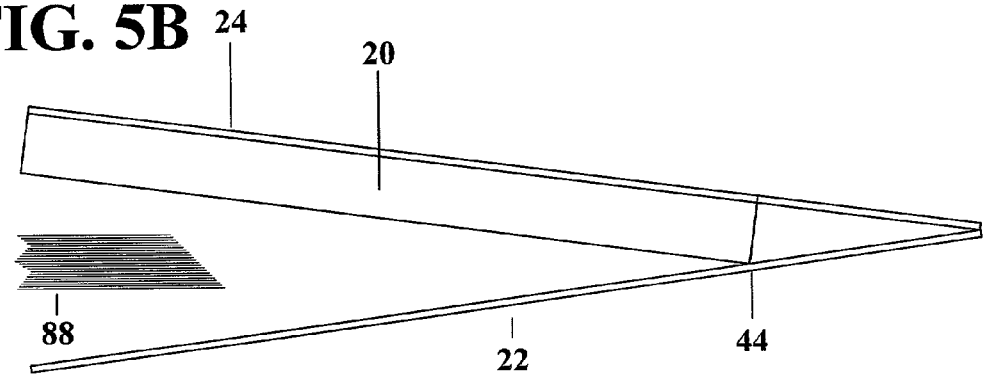
FIG. 5B shows an enlarged open position left orthographic view of same magnetic clip shown in FIG. 5A.

C) FIGS. 5A, and 5B show a standalone embodiment where the magnetic member (20) lever now has these life size Length×Width×Thickness dimensions: 0.71×0.5×0.006 inches. This standalone embodiment has 127% more holding power than the preferred embodiment but retains the same footprint, and can clip multiple sheets of paper (88), banknotes, drawings, and other thick sets of items.

Figure 4A:
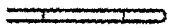
FIG. 4A shows a life size left orthographic view of a closed magnetic clip embodiment identical to said FIG. 1A without the flexible film wrapping.
Figure 4B:
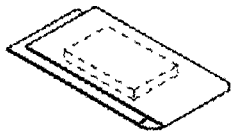
FIG. 4B shows a life size left isometric view of said magnetic clip shown in FIG. 4A.
Figure 4C:
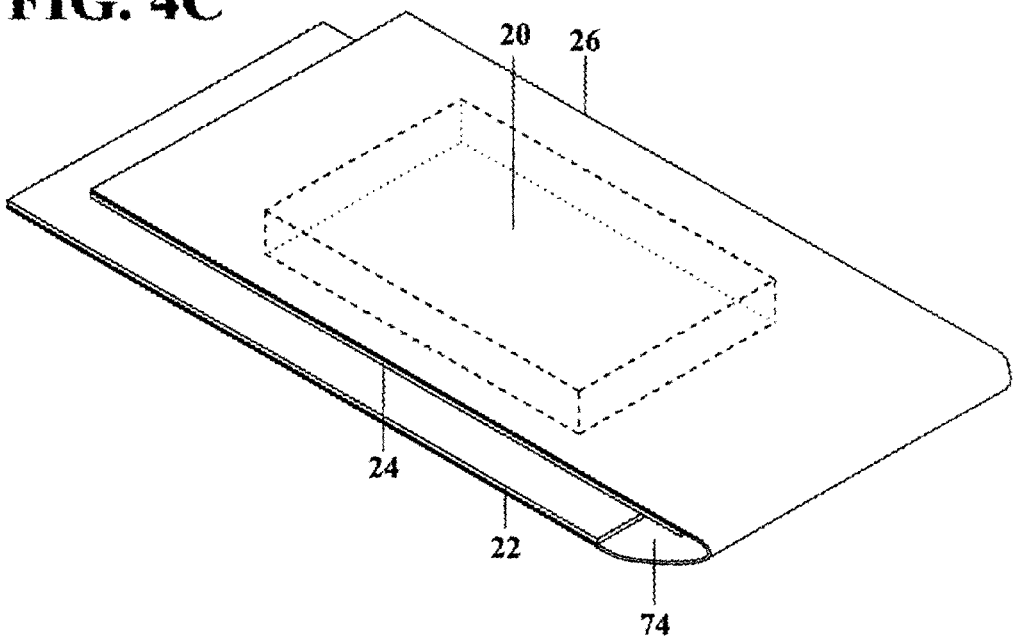
FIG. 4C shows an enlarged left isometric view of said magnetic clip shown in FIG. 4B.
Figure 4D:
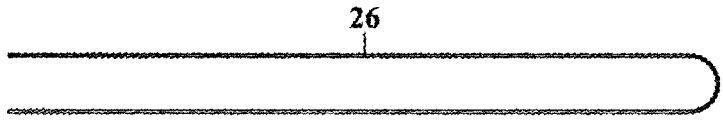
FIG. 4D shows an enlarged left isolated orthographic view of the attachment means that is attached to invention in FIG. 4A.
Figure 4E:
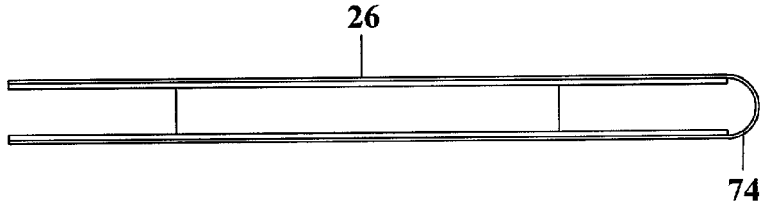
FIG. 4E shows an enlarged left side orthographic view of the magnetic clip shown in FIG. 4A.
Figure 4F:
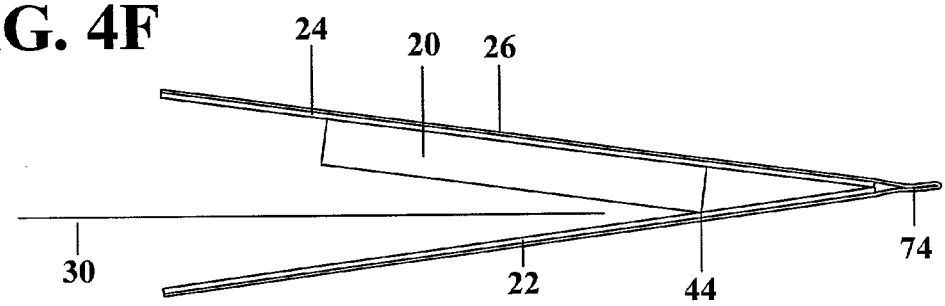
FIG. 4F shows an enlarged open position left orthographic view of same magnetic clip shown in FIG. 4A.

FIGS. 4A, and 4C show a standalone embodiment that is the same as the main embodiment except that only the second flexible film (27) of the main embodiment has not been attached.

Figure 15A:
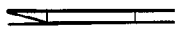
FIG. 15A shows a life size left orthographic view of a magnetic clip invention similar to said FIG. 1A except that part of the flexible film wrapping and all of the attachment means have been removed.
Figure 15B:
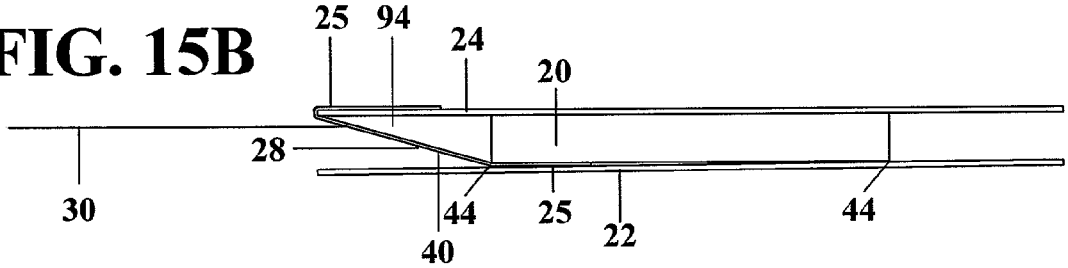
FIG. 15B shows an enlargement of the left orthographic view of the magnetic clip shown in FIG. 15A.
Figure 15C:
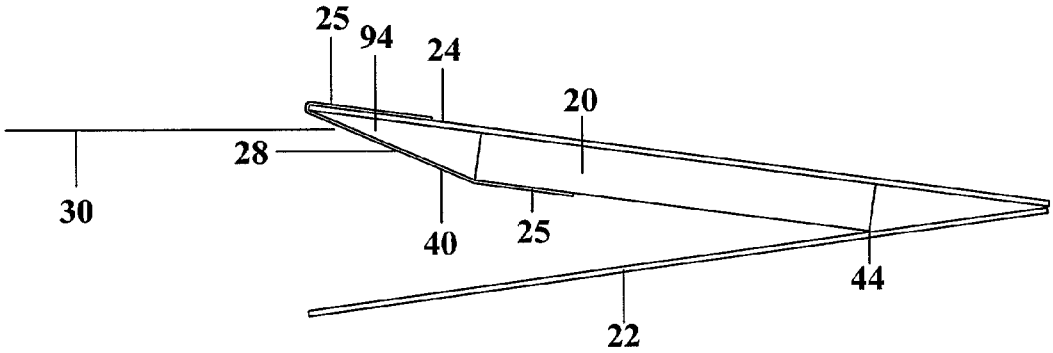
FIG. 15C shows an enlarged open position left orthographic view of the magnetic clip shown in FIG. 15A.

FIGS. 15A, 15B, and 15C standalone variation shows an embodiment where the first flexible film (25) whose slanted surface section (40) is called the first flexible film paper guide (28) has been installed, and it interconnects one end of the magnetic member (20) lever, and one end of the second firm plate (24) lever, and the attachment means of the main embodiment has not been attached.

Figure 16A:
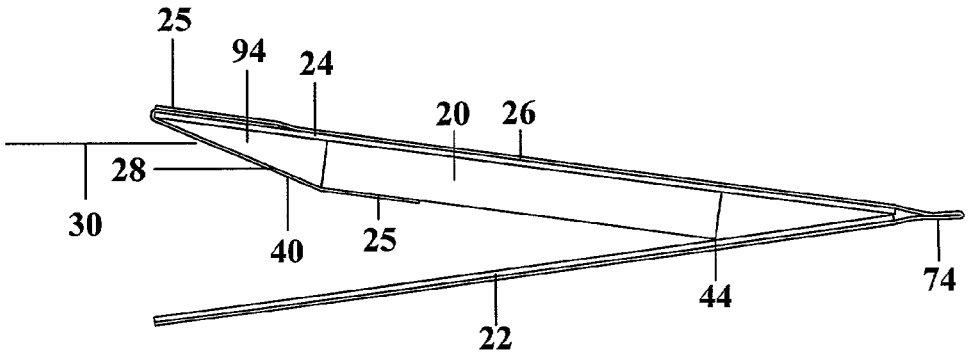
FIG. 16A shows an enlarged left orthographic view of an open position left orthographic view of the magnetic clip shown in FIG. 15C plus the inclusion of attachment means.

FIG. 16A standalone variation shown an embodiment that is exactly the same as the FIG. 15C embodiment plus the inclusion of attachment means (26).

Figure 17A:
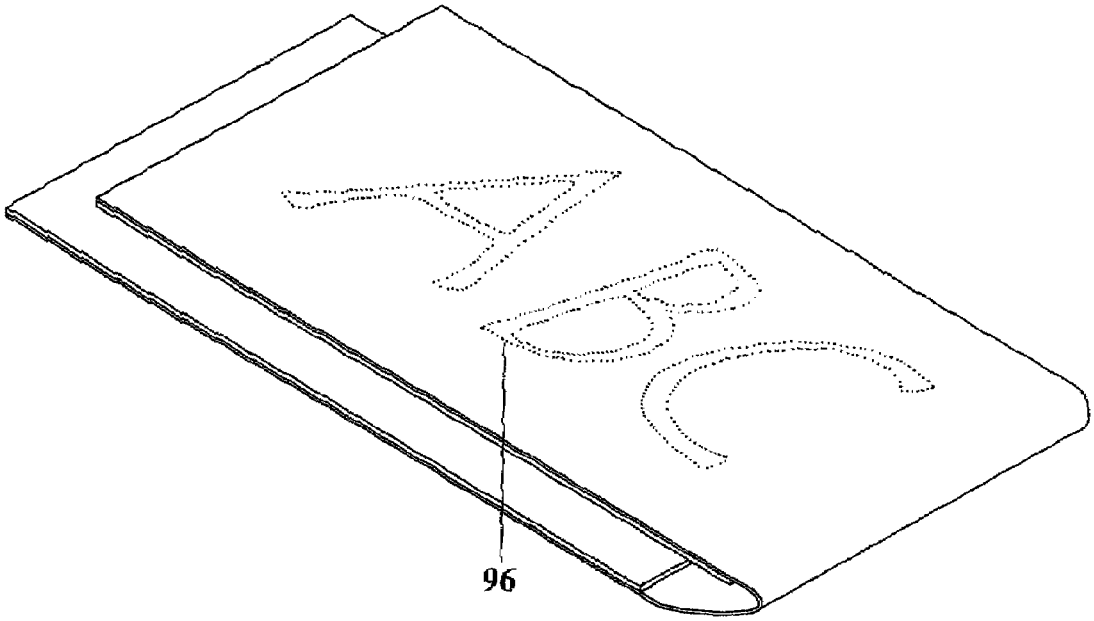
FIG. 17A shows typical signage application.

FIG. 17A shows typical signage (96) that could be applied to any decorateable surface of any embodiment of this invention.

Figure 3A:
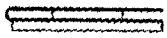
FIG. 3A shows a life size left orthographic view of another embodiment of a closed magnetic clip.
Figure 3B:
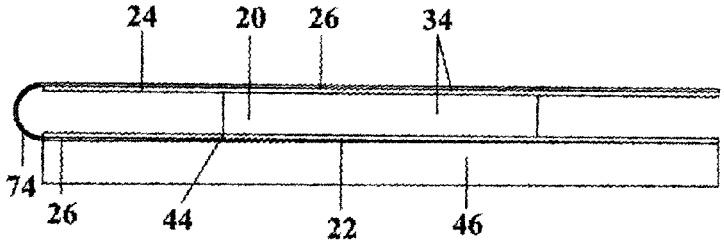
FIG. 3B shows an enlarged left orthographic view of magnetic clip shown in FIG. 3A.
Figure 3C:
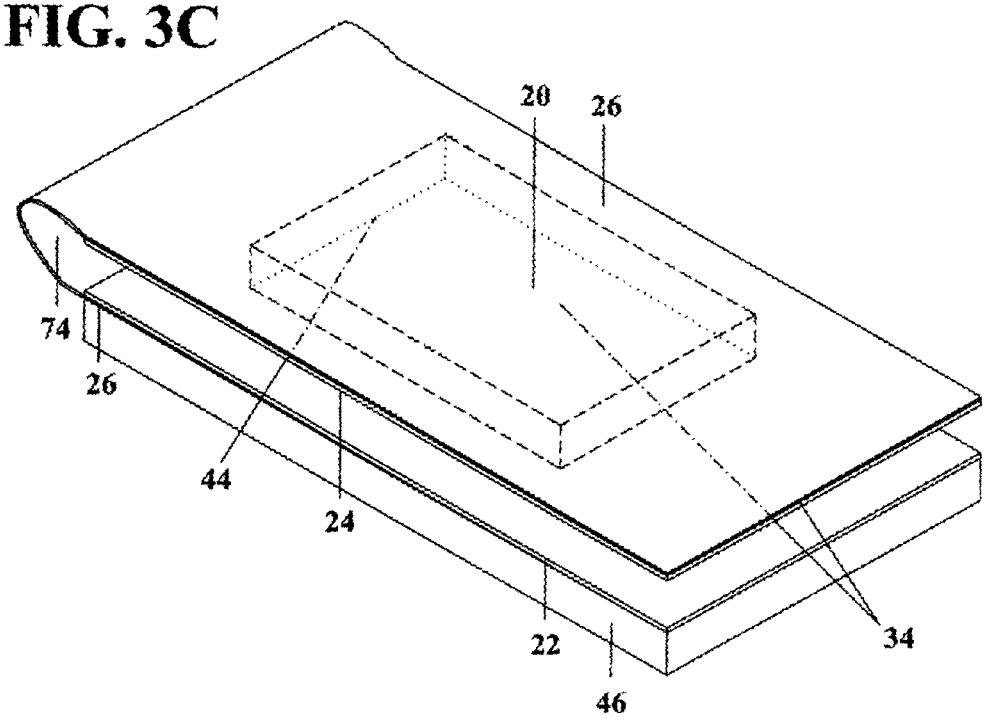
FIG. 3C shows an enlarged left side isometric view of magnetic clip shown in FIG. 3A.

FIGS. 3A, 3B and 3C standalone variation shows an embodiment where the second flexible film (27) of the main embodiment has not been attached, plus the bottom second magnetic member (46) is attached to both the outside planar surface of armature member (22) lever and to that part of the outer surface of the attachment means (26) that is attached to the outside planar surface of armature member (22) lever.

Figure 2A:
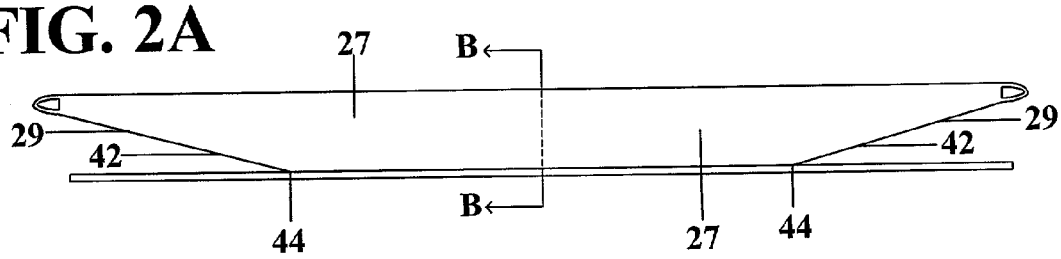
FIG. 2A shows an enlarged left orthographic view of same magnetic clip illustrated in FIG. 1E sans attachment means.

FIG. 2A standalone variation shows an embodiment in the closed position where only the attachment means of the main embodiment has not been attached. Now there are two potential fulcrums (44). Whichever section is used as the leading edge in FIG. 2A should be designated as the distal section.

Figure 2B:
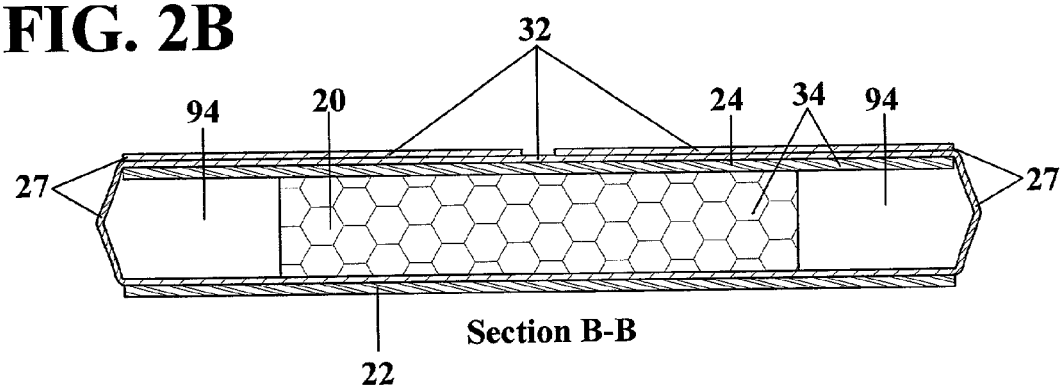
FIG. 2B shows an enlarged cross section view of said orthographic view of said closed magnetic clip shown in FIG. 2A. The cross section view is on a plane that is cut along the center lateral axis facing towards the distal section of the magnetic clip.

An enlarged cross Section B—B view at plane that is cut along the center lateral axis facing towards the distal section of the magnetic clip is illustrated in FIG. 2B, showing the second firm plate (24) lever, the combined magnetic member/second firm plate unit (34) lever, three of the four flaps of the second flexible film (32) which wrap around the combined magnetic member/second firm plate unit (34) lever, and the armature member (22) lever.

FIGS. 14A, and 14B show another life sized standalone embodiment of the magnetic clip of the present invention in 2 different views. Enlargements of FIGS. 14A, and 14B of the standalone embodiment of the magnetic clip of the present invention is illustrated in FIGS. 14C, and 14E indicating the fulcrum (44), the magnetic member (20) lever which opposes the armature member (22) lever, and the four potential loads (50), (51), (54), and (58). FIGS. 14C, and 14E, show that the magnetic member (20) lever, has a beveled edge (60) which extends laterally completely across the short side of the magnetic member lever, and is cut into the section of the magnetic member lever which faces the opposing armature member (22) lever. The angle of inclination of the inner vertex of the bevel in FIG. 14C starts at the 25.7° angle where the inner vertex (44) of the bevel on the magnetic member lever meets the armature member lever. The bevel terminates at the proximal end of magnetic member (62) lever, the outer vertex of the bevel. The cutting of the inner vertex (44) which serves as a fulcrum on the beveled edge (60) can start at any angle of inclination that is needed to produce a usable fulcrum and levers and can terminate at any location that will permit the functioning of a fulcrum and levers. As shown in FIG. 14C, just before operation of this embodiment the magnetic member (20) lever is aligned with the armature member (22) lever in face to face parallel alignment along their major planar surfaces so that the bevel's inner vertex portion can serve as a fulcrum because a predetermined portion of the opposing armature member lever will be large enough to serve as an opposing platform upon which the fulcrummed vertex can be pivoted. Typically, in a magnetic clip embodiment designed to yield a small footprint the two opposing elements have approximately these life size length×width× thickness dimensions: The magnetic member (20) lever is 0.5×0.3125×0.06 inches, and the armature member (22) lever is 0.5×0.3125×0.007 inches. This embodiment which is designed with small spatial dimensions will allow said embodiment to be securely attached to a page without inordinately enlarging and widening the interstitial spaces between the pages. Much depends upon the size of the magnetic member lever and the magnetic reach out strength of the magnet. FIG. 14E shows that the fulcrum (44) extends laterally completely across the short side of the magnetic member lever, and is located on the loci which also describe the lateral dimension of the inner vertex (44) of the beveled edge (60).

FIGS. 14C, 14D, and 14E show the six points, (64), (66), (36), (68), (70), and (72) where digital pressures are usually applied or released along the major outer surface of the magnetic member (90) lever, and the opposing armature member (80) lever to open or close the leading ends, and also show the four loads that can be turned about the fulcrum by the opposing magnetic and armature member levers (20), and (22) respectively. Load one (50) is the section of the magnetic member (20) lever that is proximal to the fulcrum. Load two (51) is the section of the magnetic member (20) lever that is distal to the fulcrum and which terminates at the leading end (86) of the magnetic member (20) lever. Load three (54) is the section of the armature member lever that is proximal to the fulcrum. Load four (58) is the section of the armature member lever that is distal to the fulcrum and which terminates at the distal leading end (82) of the armature member lever.

Figure 13A:
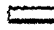
FIG. 13A shows a life size left orthographic view of another embodiment of a closed magnetic clip.
Figure 13B:
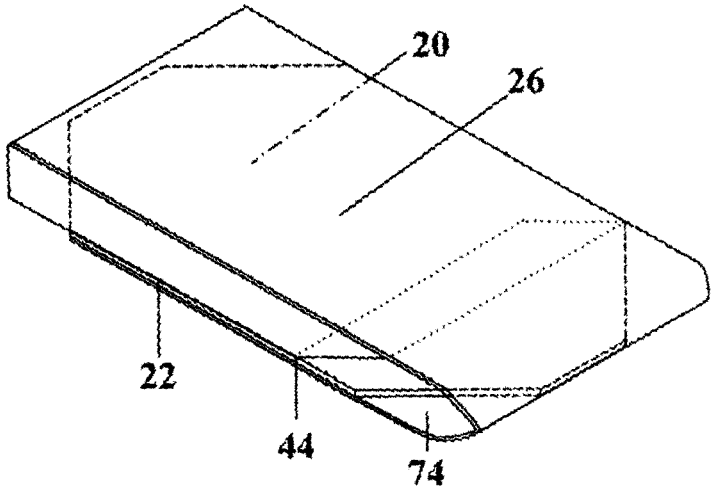
FIG. 13B shows an enlarged left isometric view of magnetic clip shown in FIG. 13A.
Figure 13C:
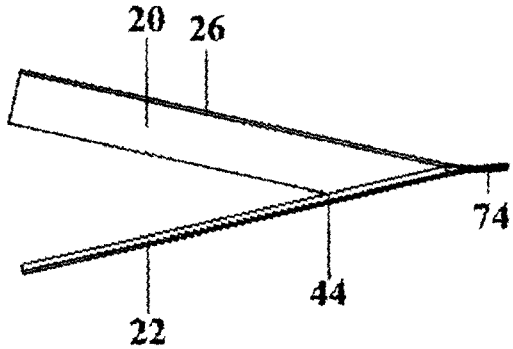
FIG. 13C shows an enlargement of orthographic view of magnetic clip shown in FIG. 13A in the open position.

FIG. 13A shows another life sized standalone embodiment of the magnetic clip of the present invention which has the same two elements of FIG. 14A plus the addition of the flexible attachment means (26). FIG. 13B illustrates an enlarged left side isometric view of FIG. 13A and shows the flexible attachment means (26) which is adhered to the outer surfaces of the magnetic member (20) lever and its opposing armature member (22) lever so that a predetermined portion (74) of the flexible attachment means, usually located towards the center of the attachment means, is not secured to any part of the armature member (22) lever, or the magnetic member (20) lever. FIG. 13C shows an enlarged left side orthographic view of the standalone embodiment shown in FIG. 13A, and illustrates FIG. 13A embodiment in the open position.

Figure 12A:
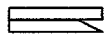
FIG. 12A shows a life size left orthographic view of another embodiment of a closed magnetic clip.
Figure 12B:
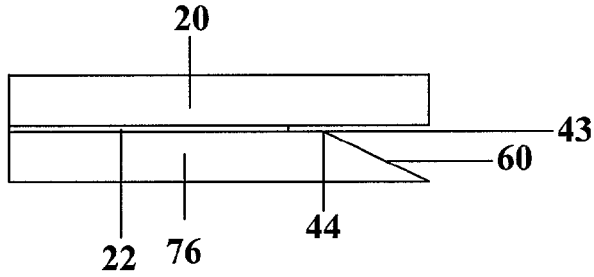
FIG. 12B shows an enlarged view of magnetic clip illustrated in FIG. 12A
Figure 12C:
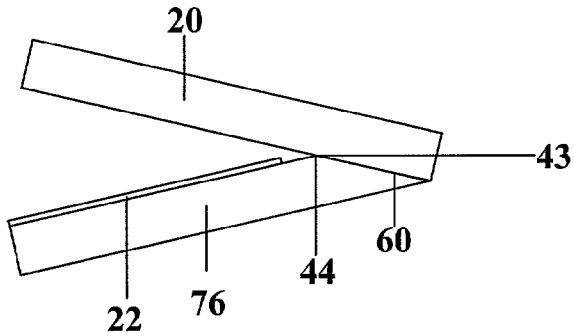
FIG. 12C shows an enlarged view of magnetic clip illustrated in FIG. 12A in the open position.

FIG. 12A illustrates a left orthographic view of another life sized standalone embodiment similar to the FIG. 14A standalone embodiment of the magnetic clip of the present invention. FIGS. 12B, and 12C both enlarged left side views, indicate the inner vertex (43) of the first firm plate (76) whose beveled edge (60) has not been cut into the magnetic member (20) lever, but has been cut into the first firm plate (76) lever, and the armature member (22) lever has been adhered to the first firm plate (76) lever which could be comprised of any firm substance, including plastic, wood, bone, and metal.

Figure 11A:
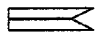
FIG. 11A shows a life size left orthographic view of another embodiment of a closed magnetic clip.

FIG. 11A shows a left orthographic view of another life sized standalone embodiment similar to the FIG. 12A standalone embodiment of the magnetic clip of the present invention. Enlarged views of the FIG. 11A standalone embodiment of the magnetic clip of the present invention is illustrated in FIGS. 11B, 11C, 11D, and 11E indicating that a bevel (60) has now also been cut into the magnetic member (20) lever so that now two beveled edges (60) and two opposing fulcrums (44), are shown, one on the first firm plate (76) lever, and the other on the magnetic member (20) lever.

FIGS. 10A, and 10B show another standalone embodiment which typically has the same sized magnetic member (20) lever, and the same size armature member (22) lever as the standalone embodiment shown in FIGS. 9A, and 9B has. Neither has a flexible attachment means (26), or a second flexible film (27) of the main embodiment attached to it. FIGS. 9A, 9B, 10A, and 10B show standalone embodiments that have different kinds of fulcrums, and levers than those of the preferred embodiment. Differentiating the two standalone embodiments shown in FIGS. 9B, and 10B from each other are the types of fulcrums each has:

A) FIG. 9B shows a fulcrum comprised of a built up steel preferably linear protrusion (48) weld welded to the proximal section of the armature member (22) lever so that the proximal section of preferably linear protrusion (48) weld can serve as a fulcrum (44). This preferably linear protrusion (48) weld is positioned between armature member (22) lever, and magnetic member (20) lever. When used as a fulcrum in a magnetic clip the typical preferably linear protrusion (48) weld's life sized diameter×width dimensions are 0.013×0.375 inches, and the typical life sized length×width×thickness dimensions for the armature member (22) lever are 0.5×0.375×0.007, and the typical life sized magnetic member (20) lever's life sized length×width×thickness dimensions are 0.5×0.375×0.06 inches.

B) FIG. 10B shows a fulcrum comprised of a preferably linear protrusion (48) which is made of a sheet of polyurethane which has these life size Length×Width×Thickness dimensions: 0.0625×0.11×0.011 inches and which is strategically attached to the proximal section of the magnetic member (20) lever of the present invention so that the proximal section of the preferably linear protrusion (48) polyurethane can serve as a fulcrum (44). The standalone embodiment shown in FIG. 10B has the typical life sized length×width×thickness dimensions for the armature member (22) lever of 0.5×0.375×0.007 inches, and the typical life sized magnetic member (20) lever's length×width×thickness dimensions are 0.5×0.375×0.06 inches.

Operation—FIGS. 1A, 1B, 1C, 1D, 1E, 1F, and 1G—Preferred Embodiment Characteristic of the operation of all of the above drawn and described embodiments is the intuitive operation of the preferred embodiment because each and everyone of the above drawn embodiments utilizes a built-in fulcrum and opposing levers:

A) As can be ascertained in the preferred embodiment FIGS. 1B, 1C, and 1E the manner of attaching the preferred embodiment to an unbound perimeter of a sheet of average thickness in a book or in a stack of sheets, is for the operator to grasp its magnetically closed parallel aligned levers along their major outer planar surfaces (80), and (90) with the major inside surface areas of opposing fingers, usually the distal sections of the thumb and index digits of one hand. Each digit is aligned in the same elongate direction as the distal and proximal sections of each lever. Sections of each opposing fingers are then pressed inwardly with a predetermined squeezing force against six outer sections of each opposing lever: One: A section located on the magnetic member (20) lever at a point that is distal (65) to the fulcrum (44). Two: An opposing section on the armature member (22) lever located distally (66) to the fulcrum (44). Three and Four: Opposing sections on both levers that are located at points (70), and (72) that are located directly over and under the fulcrum (44), respectively. Opposing five and six: Opposing sections on both levers that are located at points (37), and (67) that are proximal to the fulcrum (44). Now the operator has grasped the magnetic clip and is in full control of it.

B) Next, the operator separates the distal ends (38), and (82) of the clip away from each other by increasing the opposing inward pressures being squeezed to the opposing sections (37), and (67) located proximally to the fulcrum (44) while simultaneously reducing or even completely stopping the opposing pressures being applied inwardly to the sections (65), and (66) located distally to the fulcrum. Consequently, the sections (52) and (54), of both levers that are located proximally to the fulcrum will swivel around the fulcrum and move towards each other. Simultaneously, the sections of both levers (56), and (58) that are located distally to the fulcrum will swivel around the fulcrum and move away from each other.

C) The operator then dwellingly poises the respective separated leading edges (38) and (82) of the clip on each side of a perimeter section of a targeted sheet (30) FIG. 1B. He then moves the poised separated leading edges inwardly on either side of the targeted perimeter section of the sheet until just before the fulcrum abuts the sheet's edge. At this point in time the operator can release his grasp on the opposed portions of both levers thereby usually allowing the opposing distal sections of both levers to automatically swivel around the fulcrum back towards each other and become magnetically bonded with each other and frictionally retain the targeted sheet between the opposing distal sections of the opposing device levers. If the distal section of a lever will not automatically swivel around the fulcrum and move back towards its opposing lever the distal section of said lever can be nudged towards its opposing lever by the digit which controls that lever.

D) To advance the fulcrum inwardly and over the sheet's edge the operator frequently has to lightly decrease the inward pressure being applied by his opposing digits to the proximal sections of the clip. He then usually pushes the clip inwards until a point on the attachment means hinge fold area (74) abuts the sheet's edge. When he has removed his digits from the clip the opposing distal sections of both levers will usually automatically swivel around the fulcrum back towards each other and become magnetically bonded with each other and frictionally retain the targeted sheet between the opposing distal sections of the opposing device levers. This automatic swiveling is created by the magnetic attraction of each lever towards its opposing lever which will help cause both levers to rotate back towards each other. Maintenance of a face to face parallel alignment of the opposing members is enhanced by the attachment means (26) which helps relegate each opposing lever to a predetermined face to face parallel aligned position, thereby reducing veering, yawing, and skewing of the opposing levers away from the predetermined perpendicular and horizontal central axes during operation.

E) The pressures from the opposing digits can be equally or unequally applied in thousands of combinations, resulting in the opposing levers becoming adequately separated from each other so they can be dwellingly poised on either side of a sheet or a set of 2 or more sheets in a book with accuracy. The operator can then secure the opposing levers to any targeted position on an unbound perimeter of the sheet that he desires.

F) The manner of attaching the clip to a targeted very thin sheet, easily torn, frequently involves utilizing a magnetic member whose magnetic strength is calibrated to a predetermined low enough magnitude so that while the operator is pushing the clip inwards to achieve an abutting of the clip's proximal edge with the sheet's targeted edge, the frictional resistance of the paper to the magnetically bonded opposing levers is maximally lowered. Also, the magnetic clip will only have to slide for that distance which is measured from the fulcrum to the most proximal abutting edge of the magnetic clip due to the initial opening of the distal ends of the magnetic clip with the aid of the fulcrum and the levers and the placement of the opposing levers of the magnetic clip on opposite sides of a targeted sheet until the sheet touches the fulcrum. The magnetic clip is then slid over the sheet until a point on the attachment means hinge area (74) abuts the sheet's edge. The less sliding the less chance of wrinkling or tearing a very thin sheet of paper. The strength of the magnetic member's magnetic reach out can easily be varied by the fabricator.

G) On occasions when an attempt is being made to secure the clip to a thick object such as a thick stack of sheets in a book, or a stack of bank bills the inward progression of the clip is helped by the second flexible film paper guide (29) created on the second flexible film (27) which is adhered to the combined magnetic member/second firm plate unit (34) lever thereby creating two slanted surfaces, one at the distal end (42), and the other at the proximal end of the combined magnetic member/second firm plate unit (34) lever. The second flexible film (27) with the second flexible film paper guide (29) at the distal end of the combined magnetic member/second firm plate unit guides the inwardly moving distal end of the magnetic clip over the targeted sheet so the magnetic clip can travel over the targeted sheet unobstructed by a possible inadvertent collision between the distal rectangular front of the magnetic member (20) lever and the targeted sheet. The section of the second flexible film (27) located at the proximal end (52) of the standalone embodiment neither helps nor hinders the operation of the fulcrum (44), but it serves to prevent debris from accumulating in the interstitial crevices (94) because the flexible film (27) almost completely envelops the combined magnetic member/second firm plate unit lever (34). Texts and images can be imprinted advantageously on all viewable surfaces of the preferred embodiment, including flexible attachment means (26), second flexible film (27), second firm plate (24) lever, magnetic member (20) lever, and armature member (22) lever.

H) The normal manner of removing the magnetic clip from its attachment to a sheet or set of sheets is to place the tips (distal sections) of the thumb and index fingers on opposite sides of the set of sheet or sheets and in front of the leading edges of the attached magnetic clip, and to slide the clip off the sheet.

I) Often the operator will want to remove the clip from its attachment to a particular location on the sheet and move the clip to another location on that same sheet. In this situation the operation will place the tips (distal sections) of the thumb and index fingers on opposite sides of the set of sheet or sheets and in front of the leading edges of the attached magnetic clip and slide the clip for a short distance off the perimeter of the sheet until the fulcrum point is removed from the sheet. The operator then uses the inside planar surfaces of two opposing digits on one hand, aligning the digits in the same elongate direction as each opposing lever is aligned and grasping the magnetically closed parallel aligned levers along their major outer surface areas (90), and (80) with the (major) inside surface planes of opposing fingers, usually the distal sections of the thumb and index fingers of one hand. Sections of each opposing fingers are then pressed inwardly with a predetermined force against four outside sections of the opposing levers: One: A section of predetermined size located on the combined magnetic member/second firm plate unit (34) lever at a point that is distal (65) to the fulcrum (44). Two: An opposing section on the armature member (22) lever located distally (66) to the fulcrum (44). Three and Four: Opposing sections of predetermined dimensions on both levers that are located approximately at points (37), and (67) that are proximal to the fulcrum (44).

J) Next, the operator separates the distal ends of the clip away from each other by increasing the opposing inward pressures being applied to the sections located proximally to the fulcrum while simultaneously reducing the opposing pressures being applied inwardly to the sections distal to the fulcrum. Consequently, the sections of both levers that are located proximally to the fulcrum will swivel around the fulcrum and move towards each other. Simultaneously, the sections of both levers that are located distally to the fulcrum will swivel around the fulcrum and move away from each other. No part of the magnetic clip will now be grasping the sheet of paper and the operator can then dwellingly poise the separated opposing levers at another location on the same or other sheet and attach the clip to the targeted location or he can withdraw the clip completely away from the sheet should he have changed his mind about placing the clip on another location on this same sheet.

K) Objects other than sheets in a book can be clamped with this invention, including banknotes, large drawings, accounting ledgers, samples of fabric.

L) Preferred Embodiment Operation Summary: The operator's opposing fingers are able to apply squeezing forces to loads (52) and (54) or to loads (56) and (58) and cause the levers which comprise said four loads to move the portions of the magnetic device, that are located distally or proximally to the fulcrum, around the fulcrum, thereby creating an opening or closing of the leading edges, the distal sections of the device, as needed.

Operation—FIGS. 2A, 3A, 3B, 3C, 4C, 5A, 5B, 6A, 6B, 7B, 8A, 8D, 9A, 9B, 10A, 10B, 11B, 11C, 11D, 11E, 12B, 12C, 13B, 13C, 14C, 14D, 14E, 15A, 15B, 15C, 16A—Alternative Embodiments FIGS. 2A and 15B show standalone embodiments whose operations are very similar to the operation of the preferred embodiment in that all three embodiments can serve as a standalone magnetic clip, but with the exceptions that the attachment means (26) has been removed from the FIGS. 2A and 15B standalone embodiments, and since there is a fulcrum possibility (44) on both short side ends of FIGS. 2A and 15B embodiments either short side end can function as the distal or proximal section of FIGS. 2A and 15B embodiments during operation according to the needs of the operator so that during an operating event whichever side functions as the leading edge of FIG. 2A or 15B embodiment is called the distal section of the embodiment, and that removal of the attachment means (26) allows operator to attach these FIGS. 2A and 15B standalone embodiments anywhere on a sheet except along a bound perimeter. FIG. 15B shows the first flexible film paper guide (28) which has a slanted surface (40) and is installed on only the distal end of the FIG. 15B embodiment. This 15B embodiment allows an incoming targeted sheet (30) of paper to avoid hitting the rectangular front section of the magnetic member and thereby becoming retarded or stopped because the slanted surface guides the incoming paper away from the rectangular front surface of the magnetic member. The second flexible film paper guide (29) is installed on both ends of the FIG. 2A embodiment during the wrapping process when the second flexible film (27) is tautly wrapped around all or part of the outside surfaces of the combined magnetic member/second firm plate unit (34) lever.

FIG. 16A shows a standalone embodiment whose operation is very similar to the operation of the preferred embodiment in that can serve as a standalone magnetic clip, but with the exception that the during operation its interstitial crevice (94) would be prone to picking up and storing debris since the crevice on FIG. 16A is open to the environment.

FIGS. 4A, 4B, 4C, 4E, and 4F show a standalone embodiment whose operation is very similar to the operation of the preferred embodiment in that both embodiments can serve as a standalone magnetic clip, but with the exception that the removal of the second flexible film (27) from the preferred embodiment which functions as a paper guide for incoming targeted sheet of paper makes the process of attaching the magnetic clip to a sheet slightly more difficult since now the sheet can be retarded by the rectangular front end of the magnetic member while the magnetic clip is being moved inwards across the sheet of paper page during the process of attaching the magnetic clip thereby often requiring a second attempt to dwellingly poise the opposite elements of the clip on opposite sides of the targeted sheet. Maintenance of a face to face parallel alignment of the opposing members is enhanced by the attachment means (26) which helps relegate each opposing lever to a predetermined face to face parallel aligned position, thereby reducing veering, yawing, and skewing of the opposing levers away from the predetermined perpendicular and horizontal axes during operation.

FIGS. 3A, 3B, and 3C show a standalone embodiment whose operation is very similar to the operation of the standalone embodiment shown in FIGS. 4A, 4B, 4C, 4E, and 4F in that both embodiments can serve as a standalone magnetic clip, but with the further enhancement that the standalone embodiment shown in FIGS. 3A, 3B, and 3C can also serve as a wall magnet since its bottom second magnetic member (46) can be magnetically attached to a ferric structure such as a metal wall or refrigerator door, and after a selected object has been inserted between the bottom second magnetic member (46) and the ferric structure, and the magnetic bond between this standalone embodiment is strong enough to frictionally hold the selected object between the wall and this standalone embodiment. Often a large sheet of paper will be held between the wall and the bottom second magnetic member (46), while a smaller piece of paper is being held simultaneously between the magnetic member (20) lever and the armature member (22) lever. The easiest way to remove said embodiment from the wall is to first raise the distal end of the combined magnetic member/second firm plate unit (34) lever by pressing down on the combined magnetic member/second firm plate unit (34) lever at a location that is proximal to the fulcrum (44) thereby raising the distal section of the combined magnetic member/second firm plate unit (34) lever away from the armature member (22) lever, followed by grasping the raised distal section of the combined magnetic member/second firm plate unit (34) lever, and pulling the entire device away from the wall.

FIGS. 5A, and 5B show a standalone embodiment whose operation is very similar to the operation of the preferred embodiment in that both said embodiments can serve as a standalone magnetic clip, but with the exceptions that the attachment means (26) and the second flexible film (27) have been removed from the FIG. 5A standalone embodiment, and because magnetic member's (20) length and width dimensions have been enlarged FIG. 5B standalone embodiment's magnetic holding power has been increased while maintaining the same outer footprint as the preferred embodiment thereby helping to prevent the inadvertent dislodgement of the FIG. 5A standalone embodiment once it has been attached to a target. The FIG. 5A embodiment therefore will be valuable to operators in stressful environments such as factory workers, field engineers, etc. where books are subjected to above average hard handling. FIG. 5B illustrates the standalone embodiment's opposing levers dwellingly poised on opposite sides of a targeted thick stack of sheets preparatory to grasping the stack of sheets in a secure magnetic grip.

FIGS. 6A, and 6B show a standalone embodiment whose operation is very similar to the operation of the preferred embodiment in that both embodiments can serve as a standalone magnetic clip, but with the exceptions that the attachment means (26) and the second flexible film (27) have been removed from the FIG. 6A standalone embodiment, and since the FIG. 6A standalone embodiment contains thousands of potential fulcrums (44) on the circular sides of the magnetic member (20) lever thereby allowing any of the thousands of potential fulcrums to function as an activated fulcrum and therefore becoming the proximal section of the magnetic clip during ordinary operation. During an operating event whichever side functions as the leading edge of the magnetic clip will be designated the distal section of the magnetic clip.

FIGS. 7A, and 7B show a standalone embodiment whose operation is very similar to the operation of the preferred embodiment in that both embodiments can serve as a standalone magnetic clip, but with the exceptions that the attachment means (26) and the second flexible film (27) have been removed from the FIG. 7A standalone embodiment, and since the FIG. 7A standalone embodiment contains four potential fulcrums (44), one on each of the four rectilinear sides of the magnetic member (20) lever, any of the four potential fulcrums can serve as the distal or proximal section of the magnetic clip during operation. During an operating event whichever side functions as the leading edge of the magnetic clip will be designated the distal section of the magnetic clip.

FIGS. 9A, and 9B show a standalone embodiment whose operation is very similar to the operation of the preferred embodiment in that both embodiments can serve as a standalone magnetic clip, but with the exceptions that the attachment means (26) and the second flexible film (27) have been removed from the FIG. 9A standalone embodiment, and because a built-up preferably linear protrusion (48) weld is constructed on the proximal inner planar surface of said embodiment's armature member (22) lever shown in FIGS. 9A, and 9B, and is used as a fulcrum (44) about which both opposing levers can swivel. The preferably linear protrusion (48) weld fulcrum will be more durable than most other fulcrums described in this patent specification, and therefore the standalone embodiment shown in FIGS. 9A, and 9B will be more durable during operation than most other embodiments described in this specification. For larger applications including a clip for holding bank notes, large drawings, etc. the dimensions of this kind of clip seen in FIGS. 9A, and 9B can easily be enlarged to meet specifically stronger magnet and fulcrum requirements.

FIGS. 10A, and 10B show a standalone embodiment whose operation is very similar to the operation of the preferred embodiment in that both embodiments can serve as a standalone magnetic clip, but with the exceptions that the attachment means (26) and the second flexible film (27) have been removed from said FIG. 10A standalone embodiment, and because a different kind of fulcrum, a preferably linear protrusion (48) thin firm plate of polyurethane or other firm substance, is attached to the proximal inner planar surface of FIG. 10A's magnetic member (20) lever and is used as a fulcrum (44) about which both opposing levers swivel. The fulcrum's height will be lower than some of the other fulcrum's height described in this patent specification. Therefore the standalone embodiment shown in FIGS. 10A and 10B will be shorter through its vertical axis than are some of the other embodiments described in this specification, whose magnetic member levers are fabricated to the same vertical height and all the compared models' ferric plate levers are fabricated to the same vertical height also. The shorter the magnetic clip is through its vertical axis the more magnetic clips can be secured to different pages within a book when multiple page indicators within a single book are needed. The utility of a vertically short fulcrum is, therefore, very practical because the smaller the fulcrum in a magnetic clip is, the less bulging out of the combined clips will be caused by multiple applied magnetic clips secured between the book's covers since the volume of interstitial space between pages created by and partially occupied by the standalone embodiment shown in FIG. 10A will be minimized. Therefore, more of the standalone embodiment shown in FIG. 10A can be clipped to various different pages within the same book without causing the book's girth to widen and bulge out significantly. Hence the operator can utilize several magnetic clips during an operating event with minimum alteration of the book's physical conformation.

Figure 8A:
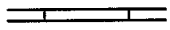
FIG. 8A shows a life size left orthographic view of a magnetic clip invention similar to said FIG. 1A except that both the flexible film wrapping and the attachment means have been removed.
Figure 8B:
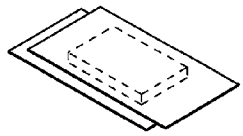
FIG. 8B shows a life size left isometric view of same magnetic clip invention illustrated in FIG. 8A.
Figure 8C:
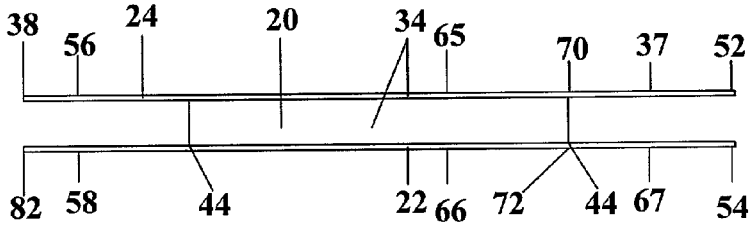
FIG. 8C shows an enlargement of the left orthographic view of the magnetic clip shown in FIG. 8A.
Figure 8D:
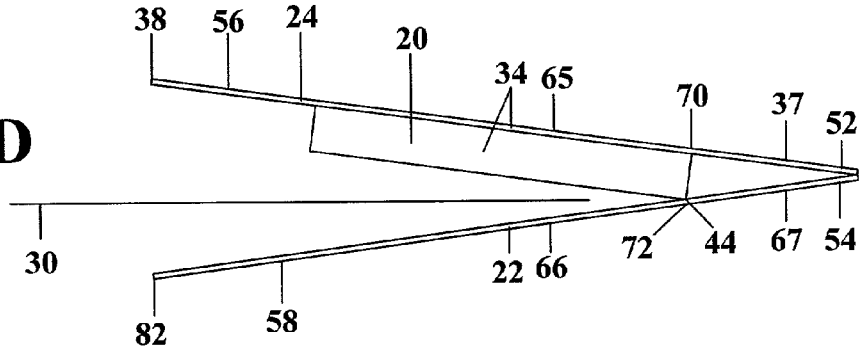
FIG. 8D shows an enlarged open position left orthographic view of the magnetic clip shown in FIG. 8A.
Figure 8E:
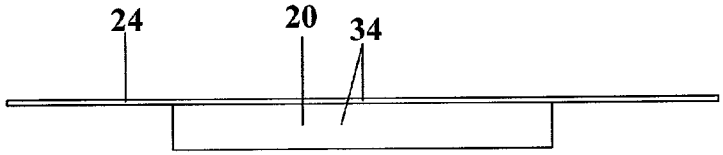
FIG. 8E shows an enlargement of left orthographic view of combined magnetic member/second firm plate unit (34).
Figure 8F:
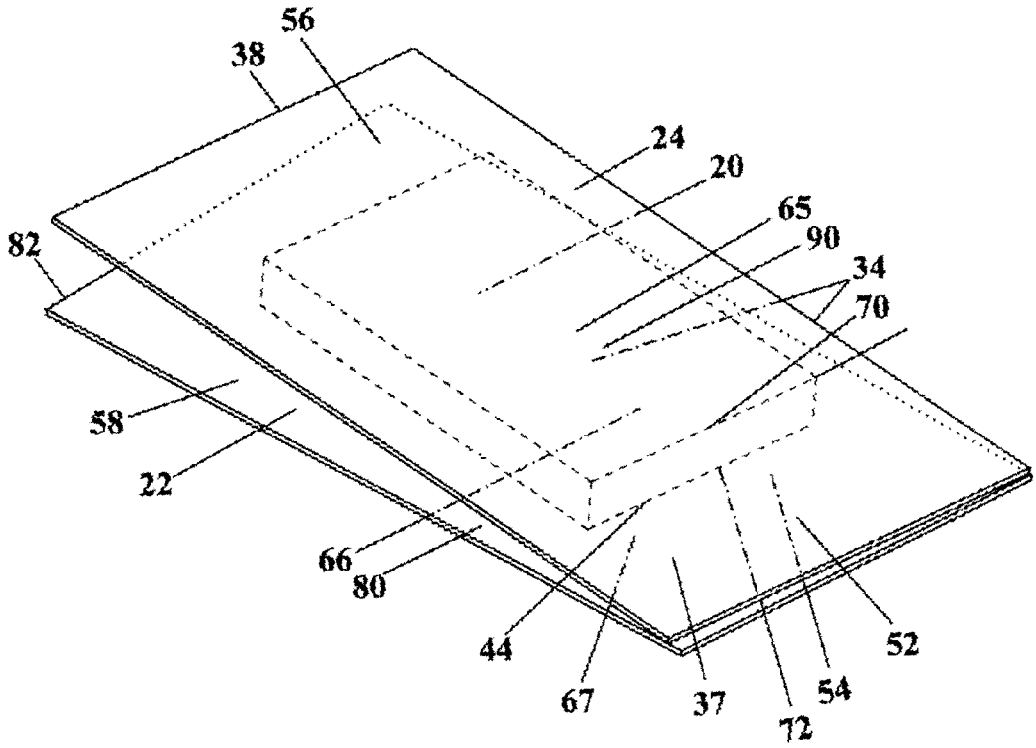
FIG. 8F shows an enlarged left isometric view of same magnetic clip shown in FIG. 8A whose leading edges are elevated away from each other.

FIGS. 8A, 8B, 8C, 8D and 8F show a standalone embodiment whose operation is very similar to the operation of the preferred embodiment in that both embodiments can serve as a standalone magnetic clip, but with the exceptions that the attachment means (26) and the second flexible film (27) have been removed from the FIG. 8A standalone embodiment, and since there is a fulcrum possibility (44) on both short side ends of the magnetic member (20) lever either short side end can function as the distal or proximal section of the magnetic clip during operation according to the needs of the operator, and during an operating event whichever side functions as the leading edge of the magnetic clip is called the distal section of the magnetic clip.

The operation of the standalone embodiments shown in FIGS. 11A, 11B, 11C, 11D, 11E, 12A, 12B, 12C, 14A, 14B, 14C, 14D, and 14E is very similar to the operation of the FIG. 1A preferred embodiment in that the operator's fingers are placed at similar points relative to the fulcrum on all standalone embodiments to control the attachment to, or detachment from, a targeted sheet or set of objects. Those standalone embodiments shown in FIGS. 11A, 11B, 11C, 11D, 11E, 12A, 12B, 12C, 14A, 14B, 14C, 14D, and 14E, however, can be attached anywhere on a paper sheet except along a bound perimeter edge of a sheet:

FIGS. 14A, 14B, 14C, 14D, and 14E illustrate a standalone embodiment which can be comprised of a very thin magnetic member opposing a very thin armature member so that the volume of interstitial spaces between pages occupied by the standalone embodiment is minimized, therefore, more of the standalone embodiment can be clipped to various different pages within the same book without causing the book's girth to widen and bulge out significantly. Hence the operator can utilize several magnetic clips during an operating event without significantly altering the book's physical conformation.

FIGS. 12A, 12B, and 12C show a standalone embodiment which protects the user's fingers from being accidentally cut by the very thin armature member (22) lever during operation because the thicker first firm plate (76) lever, on which the fulcrum (44) is built, is adhered to the thin armature member (22) lever in such a manner as to ensure that the fingers of the user, during operation of the magnetic clip, are not exposed to the sharp edges of the armature member (22) lever thereby making this embodiment child safe.

Figure 11B:
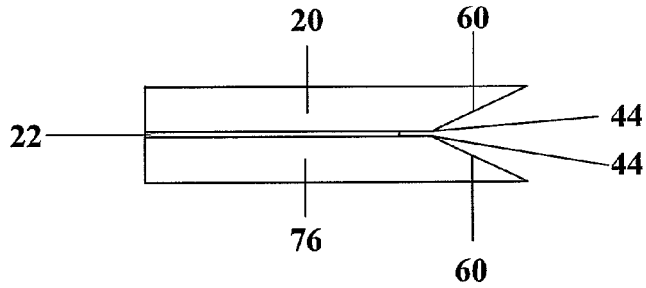
FIG. 11B shows an enlarged view of magnetic clip illustrated in FIG. 11A
Figure 11C:
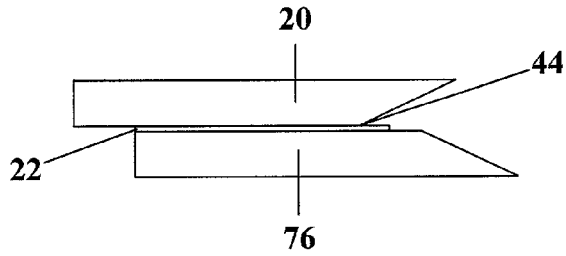
FIG. 11C shows said magnetic clip illustrated in FIG. 11A with the magnetic member lever's farthest distal point not touching the extreme distal point of the armature member lever.
Figure 11D:
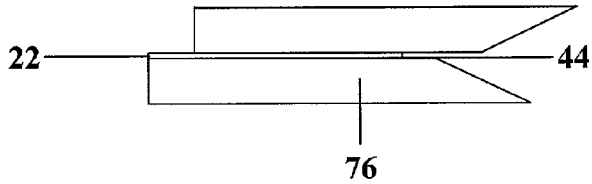
FIG. 11D shows said magnetic clip illustrated in FIG. 11A with the magnetic member lever's extreme inner proximal point not touching the extreme inner proximal point of the ferric armature member lever or the extreme inner proximal point of the first firm plate lever
Figure 11E:
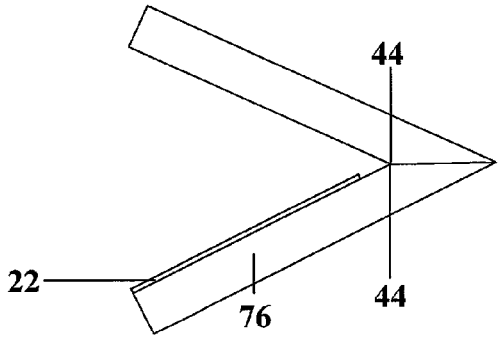
FIG. 11E shows said magnetic clip illustrated in FIG. 11A with the leading ends separated from each other.

FIGS. 11A, 11B, 11C, 11D, and 11E show a standalone embodiment which demonstrates that this magnetic clip invention can have one opposing fulcrum (44) at the inner vertex on each opposing beveled edge (60), and that either fulcrum can be used as the pivoting point upon which its opposing fulcrum is positioned during operation. FIG. 11B shows that there is one potential fulcrum (44) on each of the two proximal inner vertexes of both opposing levers of the magnetic clip. During an operating event the position of the inner vertex relative to the position of its opposing member's inner vertex will determine whether that vertex or even both vertexes can function as an individual fulcrum or simultaneous fulcrums. FIG. 11E shows two opposite fulcrums each of which has used its opposing fulcrum as a platform upon which it, and the lever on which it has been formed, to swivel about its opposing fulcrum. FIG. 11C shows positioning prior to fulcrum activation in which only the inner vertex (44) of the magnetic member (20) lever is usually used as a fulcrum. FIG. 11D shows positioning prior to fulcrum activation in which only the inner vertex (44) of the first firm plate (76) lever is usually used as a fulcrum. The process by which the fulcrum on an opposing lever uses its opposing lever's fulcrum as a platform about which it can turn is facilitated by the magnetic bond between both opposing members which holds its opposing member in a stabilized opposing magnetically bonded alignment until the very last instant when the rotational movement of each member past its opposing member is finalized. As shown in FIGS. 11C, and 11D the first firm plate (76) lever contains a fulcrum (44) and is adhered to an armature member (22) lever. This first firm plate (76) lever can be comprised of any firm substance, including wood, plastic, rubber, metal, and numerous other firm substances.

FIGS. 13A, 13B, and 13C illustrate a standalone embodiment which shows that when the magnetic member (20) lever, and the ferric armature member (22) lever are manipulated during the operation of shown standalone embodiment, maintenance of a face to face parallel alignment of the opposing members is enhanced by attachment means (26) which helps relegate each opposing lever to a predetermined face to face parallel aligned position, thereby reducing veering, yawing, and skewing of the opposing levers away from the predetermined perpendicular and horizontal axes during operation.

Conclusion, Ramifications, and Scope

Although the description above contains many specificities, these should not be construed as limiting the scope of the invention but as merely providing illustrations of some of the present embodiments of this invention.

A) Any or all of the levers; the magnetic member lever, the armature member lever, or the second firm plate lever can have other shapes, such as circular, oval, trapezoidal, triangular, etc.

B) The hinge fold area (74) of the attachment means can be extended so the magnetic clip can clasp as many sheets as the hinge area is designed to expand to, and the size and magnetic reach out strength of the magnet can grasp securely.

C) Any embodiment can have a ferric backup plate affixed to the outside surface of the magnetic member to increase the magnetic reach-out strength of the magnetic member.

D) An attachment means (26) can be attached to any of the shown embodiments so that when the magnetic member lever and the ferric armature member lever are manipulated during the operation of any of said embodiments the face to face parallel alignment of the opposing members is enhanced because the attachment means (26) will help relegate each opposing lever to a predetermined face to face parallel aligned position, thereby reducing veering, yawing, and skewing of the opposing levers away from the predetermined perpendicular and horizontal axes during operation.

E) Any of the shown embodiments can be constructed without an attachment means (26), and with magnets having sufficient reach out power, thereby enabling concerned embodiment to be securely attached to any part of the targeted sheet except along the bound edge of a sheet or group of sheets such as in a book.

F) Lever plate surfaces do not have to be absolutely flat or smooth. Any of the lever surfaces could have undulations, indentations and even holes on or in them as long as the fulcrum, levers, and reach out power of the magnet permit the magnetic clip to grasp its target securely.

G) The bevel which is cut across the lateral dimension of the magnetic member as in FIG. 14A could also be cut across the long dimension of the magnetic member. This will lessen the chance that the magnetic clip during use will cover up the image on the printed page.

H) The magnetic member levers, armature member levers, and the "firm plate" fulcrums of models seen in FIGS. 9B and 10B can be fabricated to various thicknesses.

I) The magnetic clips shown in FIGS. 9B, and 10B, one having the firm plate fulcrum, and the other the built up weld fulcrum, respectively, can have its preferably linear protrusion (48) placed near the middle of the magnetic clip and then either the proximal or distal sides of either of the protrusions can serve as the active fulcrum and there will be two fulcrum possibilities in this new configuration.

J) Thus the scope of the invention should be determined by the appended claims and their legal equivalents, rather than by the examples given.

I claim:

1. A magnetic bookmark releasably securable to a selected position on a page, comprising: a planar magnetic member (20); a planar ferric armature member (22) randomly juxtaposed with respect to longitudinal orientation and magnetically attached to said magnetic member; means for allowing said juxtaposed members to pivotably separate at one side in response to application of a squeezing force at the opposite side of said members;

attachment means (26) hingedly connecting said magnetic member and said armature member;

said means for allowing said juxtaposed members to pivotably sepatare including a firm plate (24) secured to said magnetic member (20) on the side opposite from said armature member (22), said armature member and said firm plate each being of a like dimension and greater than the dimension of said magnetic member, to overlap and provide a fulcrum (44) between said armature member and said firm plate, and a flexible film paper-guide (29) covering an inner side of said magnetic member (20), and wrapped over and covering at least a portion of an outer side of said firm plate (24).

2. A magnetic bookmark releasably securable to a selected position on a page, comprising: a planar magnetic member (20); a planar ferric armature member (22) randomly juxtaposed with respect to longitudinal orientation and magnetically attached to said magnetic member; means for allowing said juxtaposed members to pivotably separate at one side in response to application of a squeezing force at the opposite side of said members including a firm plate (24) secured to said magnetic member (20) on the side opposite from said armature member (22), said armature member and said firm plate each being of a like dimension and greater than the dimension of said magnetic member, to overlap and provide a fulcrum (44) between said armature member and said firm plate, and a flexible film paper-guide (29) covering an inner side of said magnetic member (20), and wrapped over and covering at least a portion of an outer side of said firm plate (24).

3. A magnetic bookmark releasably securable to a selected position on a page, comprising: a planar magnetic member (20); a planar ferric armature member (22) randomly juxtaposed with respect to longitudinal orientation and magnetically attached to said magnetic member; means for allowing said juxtaposed members to pivotably separate at one side in response to application of a squeezing force at the opposite side of said members including a firm plate (24) is secured to said magnetic member (20) on the side opposite from said armature member (22), said armature member and said firm plate each being of a like dimension and greater than the dimension of said magnetic member, to overlap and provide a fulcrum (44) between said armature member and said firm plate, a flexible film paper-guide (28) interconnecting one end of said magnetic member (20) with one end of said firm plate (24); and attachment means (26) hingedly connecting said magnetic member and said armature member.

4. A magnetic bookmark releasably securable to a selected position on a page, comprising a planar magnetic member (20), a planar ferric armature member (22) randomly juxtaposed with respect to longitudinal orientation and magnetically attached to said magnetic member; means for allowing said juxtaposed members to pivotably separate at one side in response to application of a squeezing force at the opposite side of said members including a firm plate (24) is secured to said magnetic member (20) on the side opposite from said armature member (22), said armature member and said firm plate each being of a like dimension and greater than the dimension of said magnetic member, to overlap and provide a fulcrum (44) between said armature member and said firm plate; and a flexible film paper-guide (28) interconnecting one end of said magnetic member (20) with one end of said firm plate (24).

* * * * *